US007547118B2

(12) United States Patent
Gordin et al.

(10) Patent No.: US 7,547,118 B2
(45) Date of Patent: Jun. 16, 2009

(54) MECHANISM TO INSURE CORRECT ROTATION OF ARC TUBE IN SOCKET

(75) Inventors: Myron K. Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 148 days.

(21) Appl. No.: 11/333,118

(22) Filed: Jan. 17, 2006

(65) Prior Publication Data

US 2006/0181881 A1 Aug. 17, 2006

Related U.S. Application Data

(60) Provisional application No. 60/644,687, filed on Jan. 18, 2005, provisional application No. 60/644,639, filed on Jan. 18, 2005, provisional application No. 60/644,536, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No. 60/644,688, filed on Jan. 18, 2005, provisional application No. 60/644,636, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,638, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005.

(51) Int. Cl.
*F21K 7/00* (2006.01)

(52) U.S. Cl. ..... 362/287; 362/261; 362/297

(58) Field of Classification Search ..... 362/346, 362/287

See application file for complete search history.

(56) References Cited

U.S. PATENT DOCUMENTS

| | | | | |
|---|---|---|---|---|
| 1,586,795 | A | | 6/1926 | Godley |
| 2,447,923 | A | | 8/1948 | Tuck |
| 4,173,037 | A | * | 10/1979 | Henderson et al. ..... 362/287 |
| 4,816,974 | A | | 3/1989 | Gordin |
| 4,947,303 | A | | 8/1990 | Gordin et al. |
| 5,161,883 | A | | 11/1992 | Gordin et al. |
| 5,600,537 | A | | 2/1997 | Gordin et al. |

(Continued)

FOREIGN PATENT DOCUMENTS

EP 1 172 839 A2 1/2002

(Continued)

*Primary Examiner*—Anabel M Ton
(74) *Attorney, Agent, or Firm*—McKee, Voorhees & Sease, P.L.C.

(57) ABSTRACT

An apparatus and method for allowing rotational adjustment of a thread-in HID light source to a lighting fixture when in operative position in the fixture. In one aspect of the invention, a conventional thread-in arc lamp is threadably insertable into a socket that is mounted in the light fixture. A mounting interface is adapted to allow some rotation of the socket over a range.

5 Claims, 29 Drawing Sheets

U.S. PATENT DOCUMENTS 5,609,413 A 3/1997 Lecluze et al.
5,816,691 A 10/1998 Gordin et al.
5,856,721 A 1/1999 Gordin et al.
6,036,338 A 3/2000 Gordin
6,203,176 B1 3/2001 Gordin
6,502,965 B1 * 1/2003 Bradford ..... 362/346

FOREIGN PATENT DOCUMENTS

WO PCT/US2006/001534 5/2006

* cited by examiner

Figure 5A:
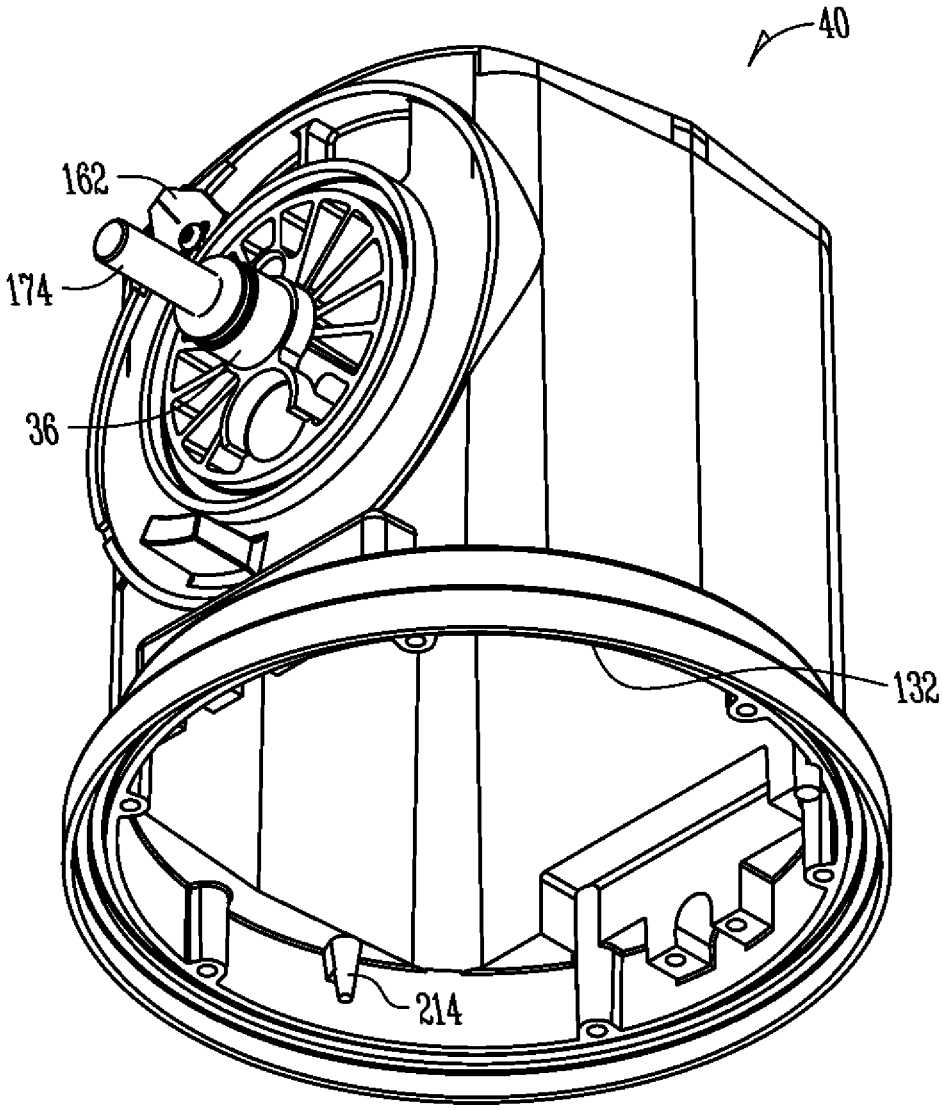
Figure 5B:
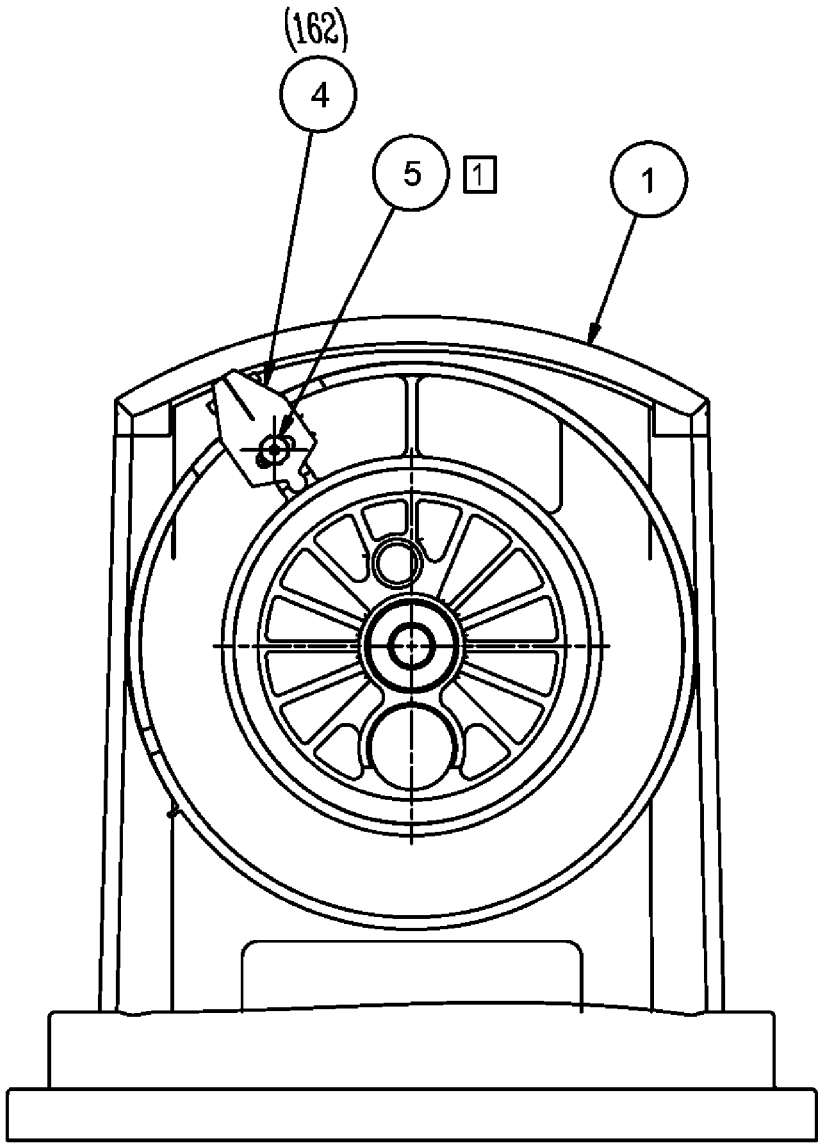

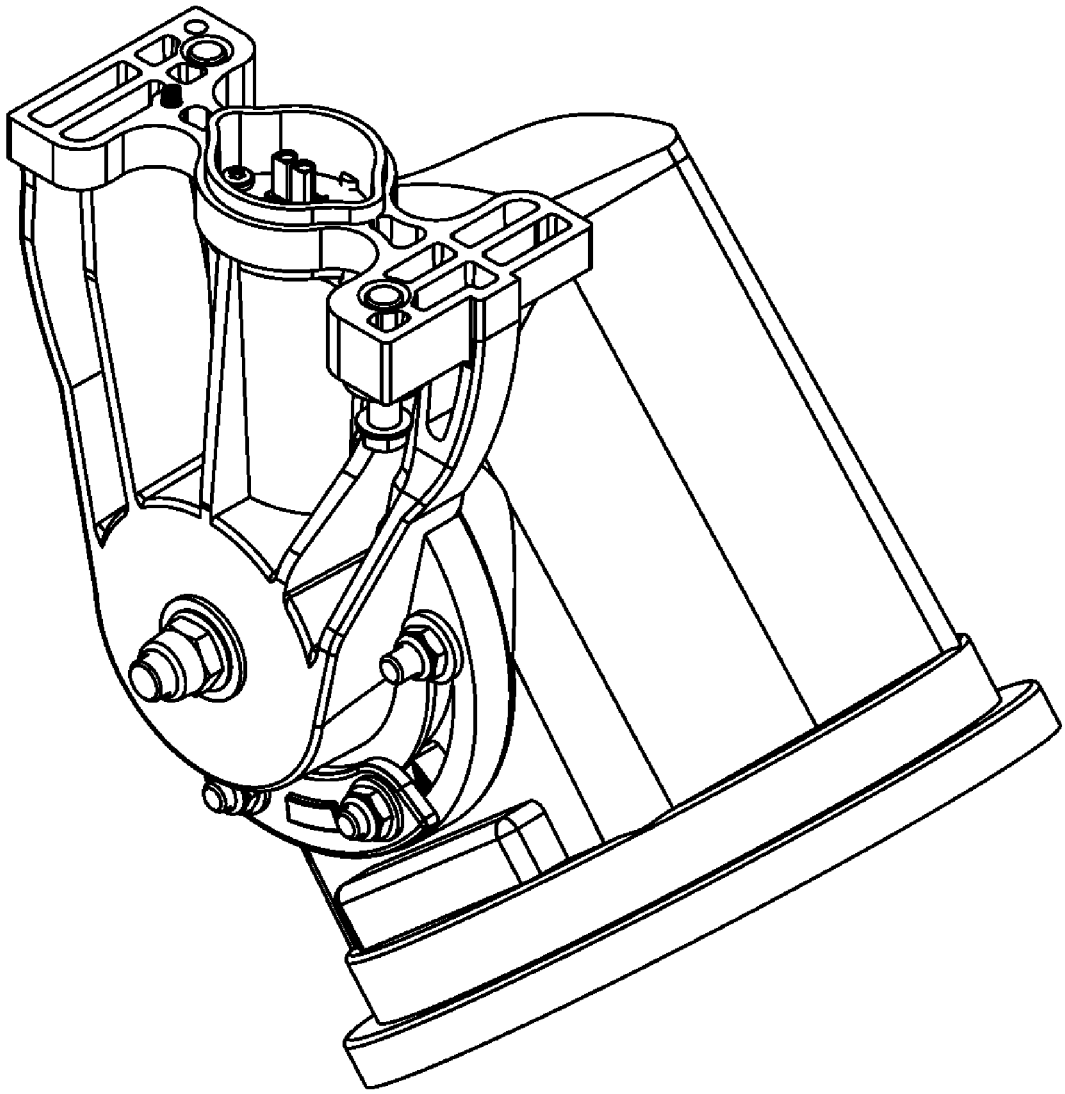
Fig. 5J1

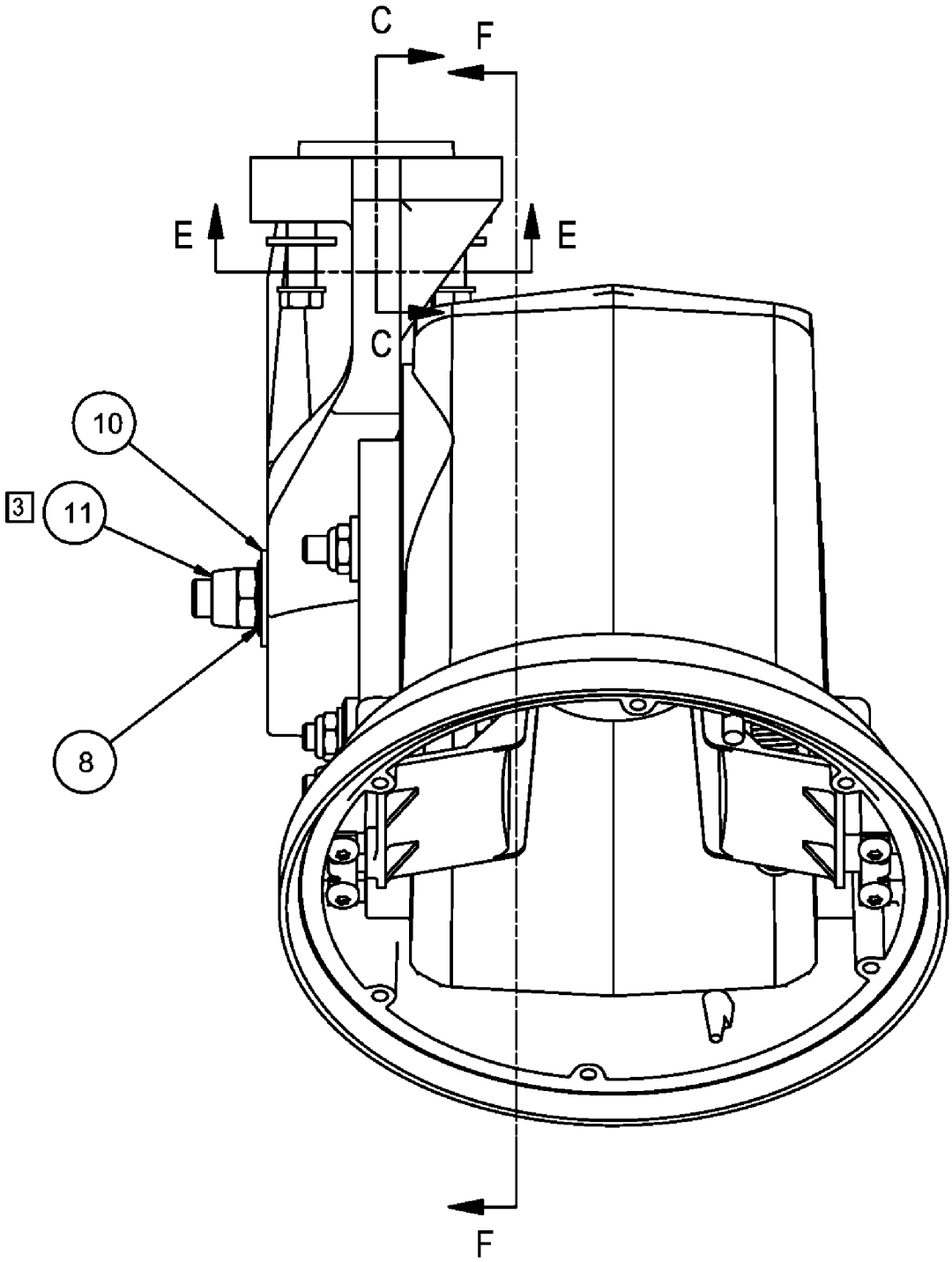
Fig.5J2

Figure 3:
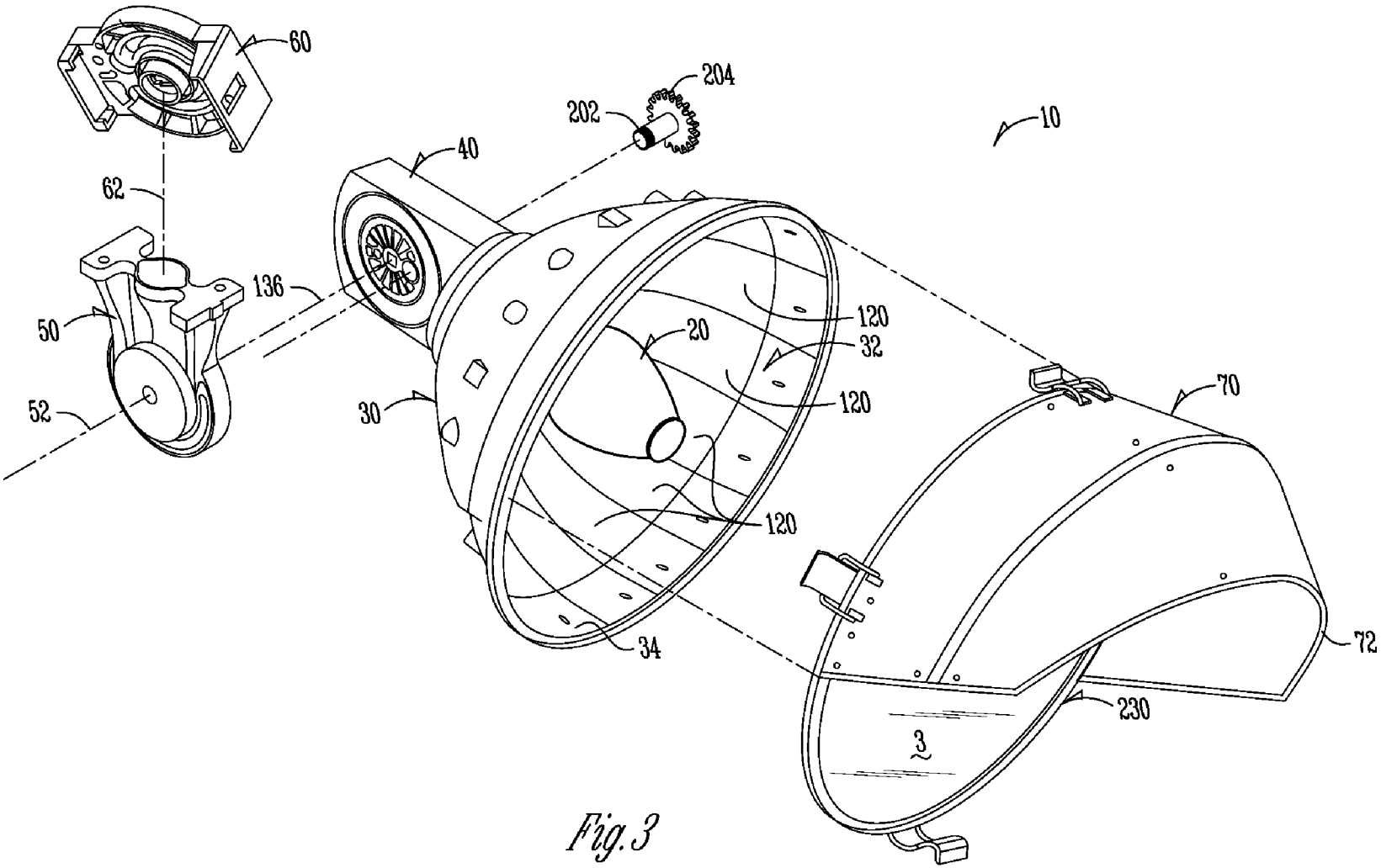
Figure 4A:
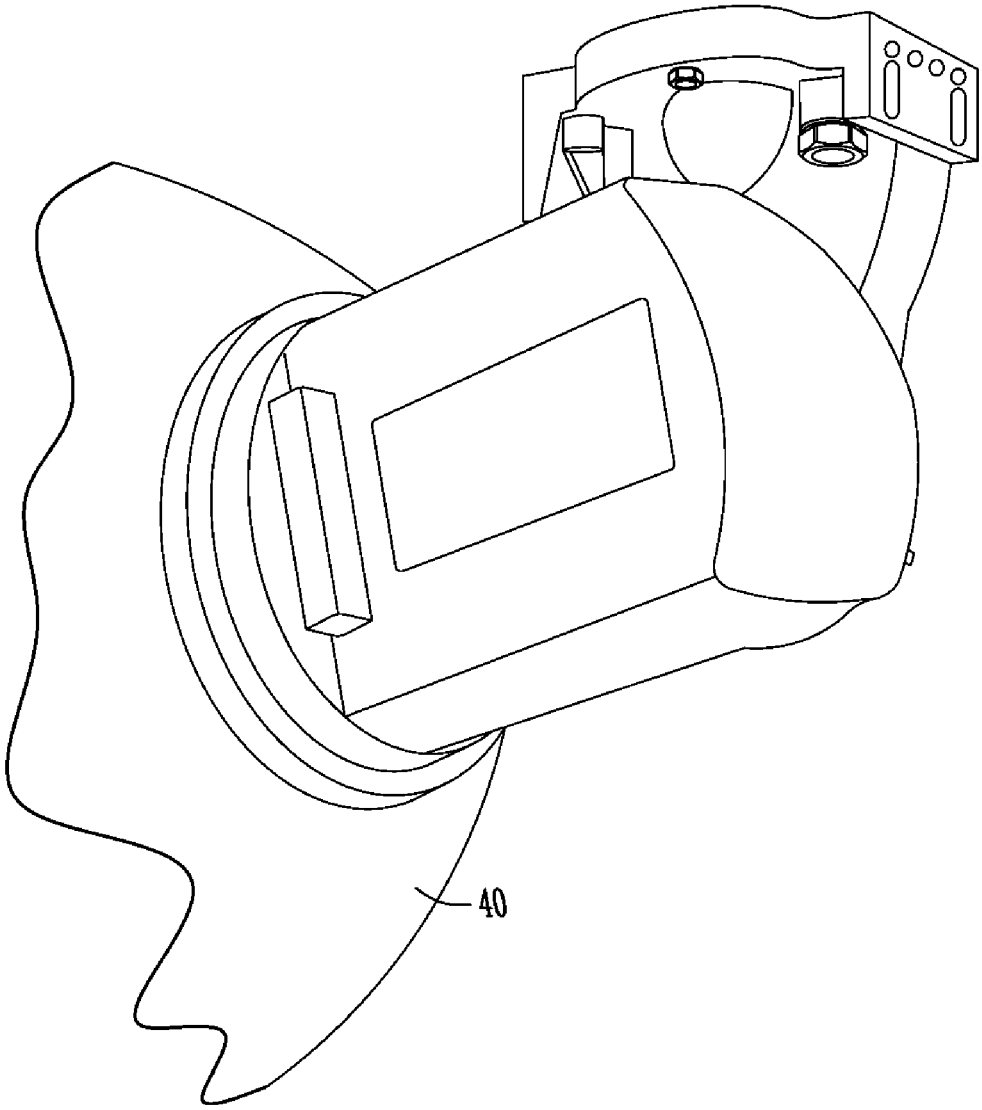
Figure 4B:
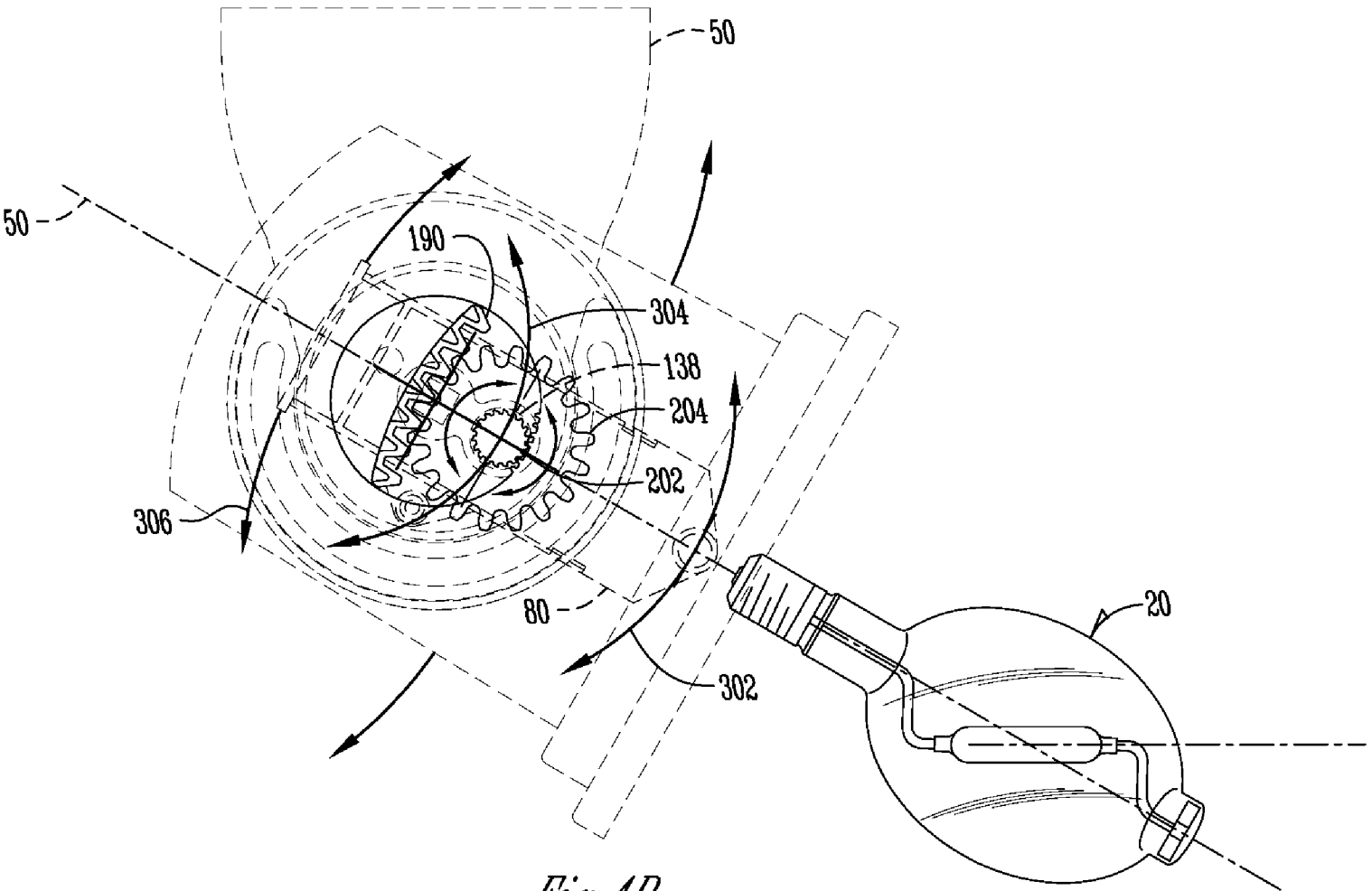
Figure 4C:
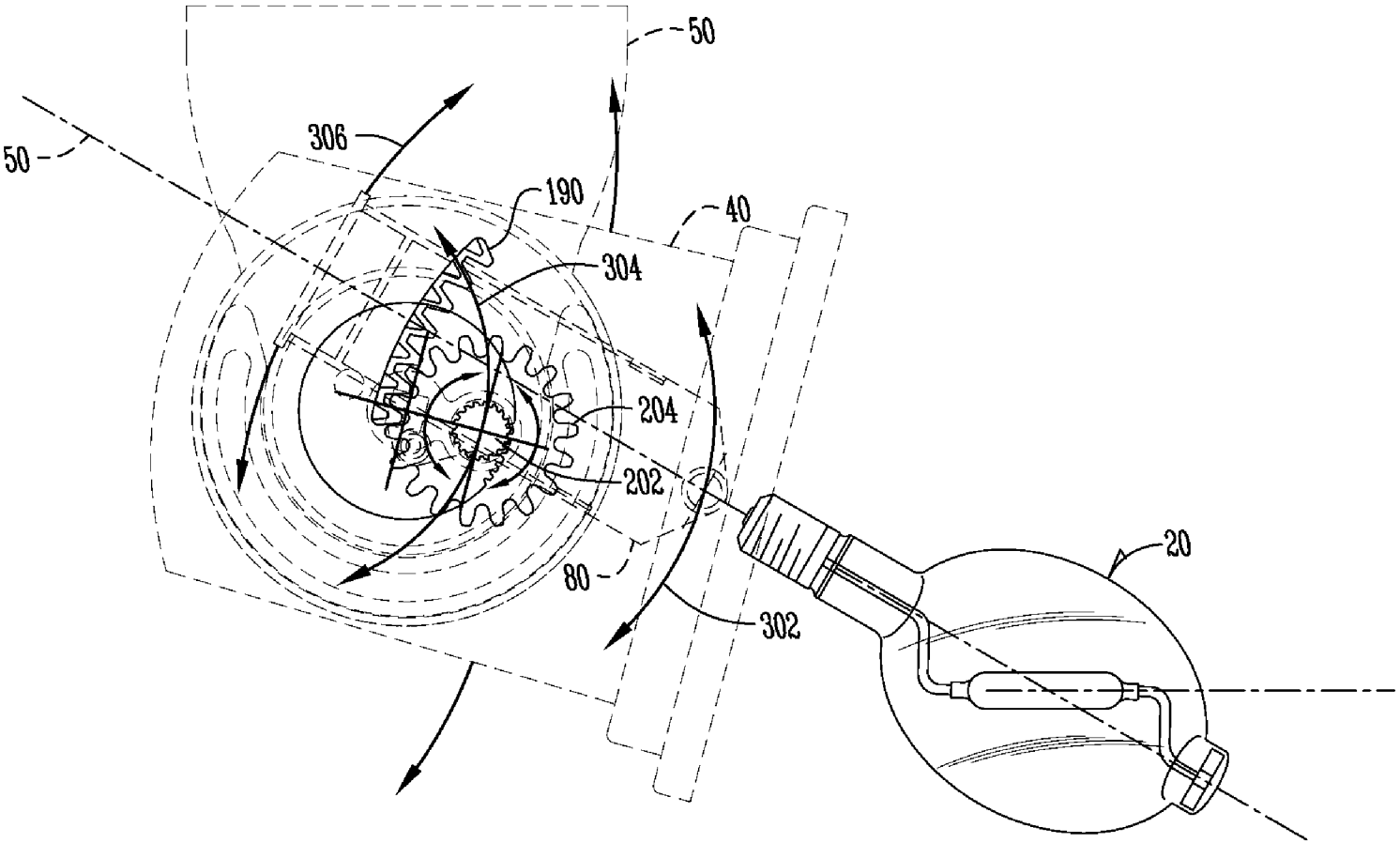
Figure 4D:
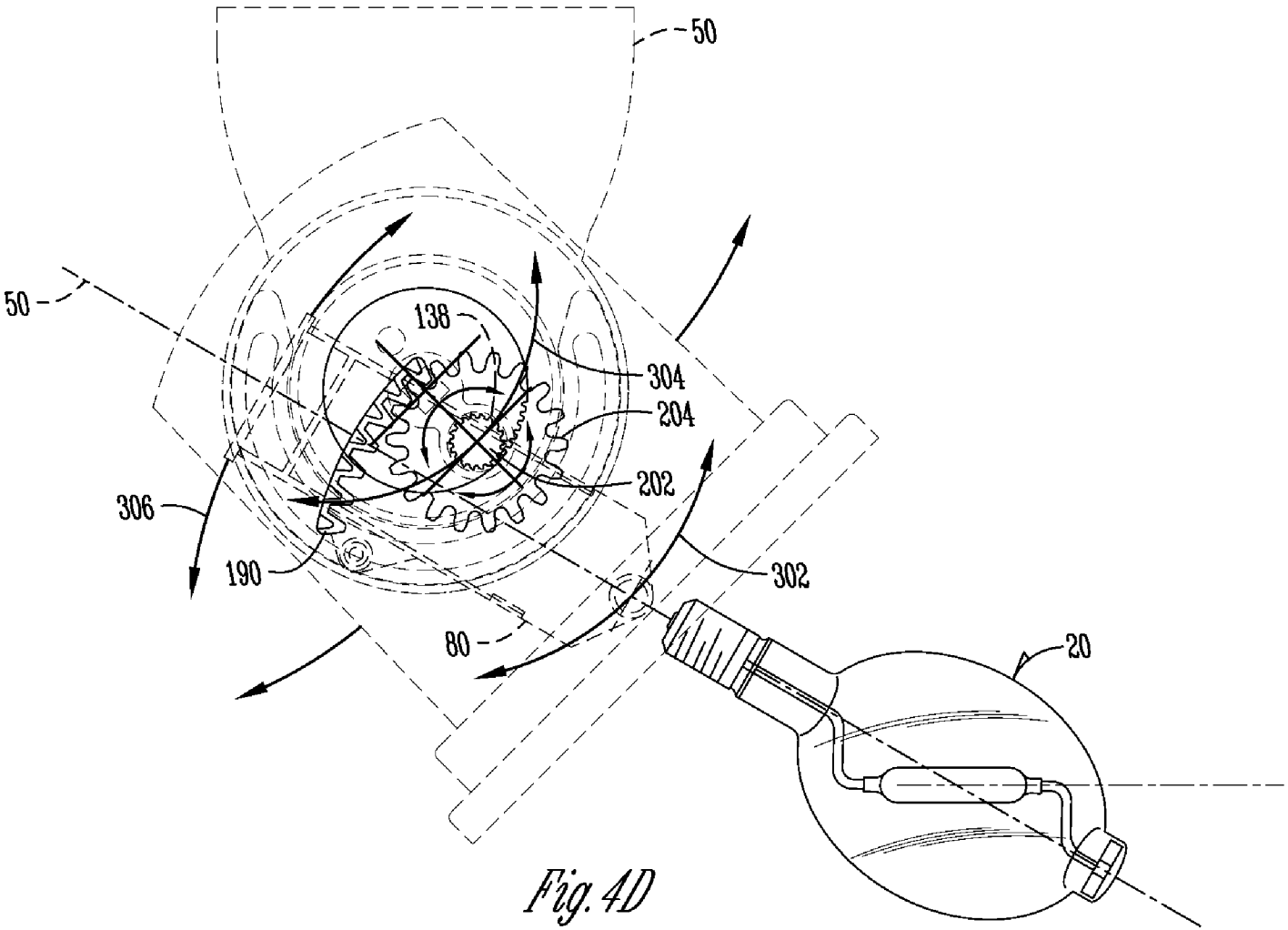

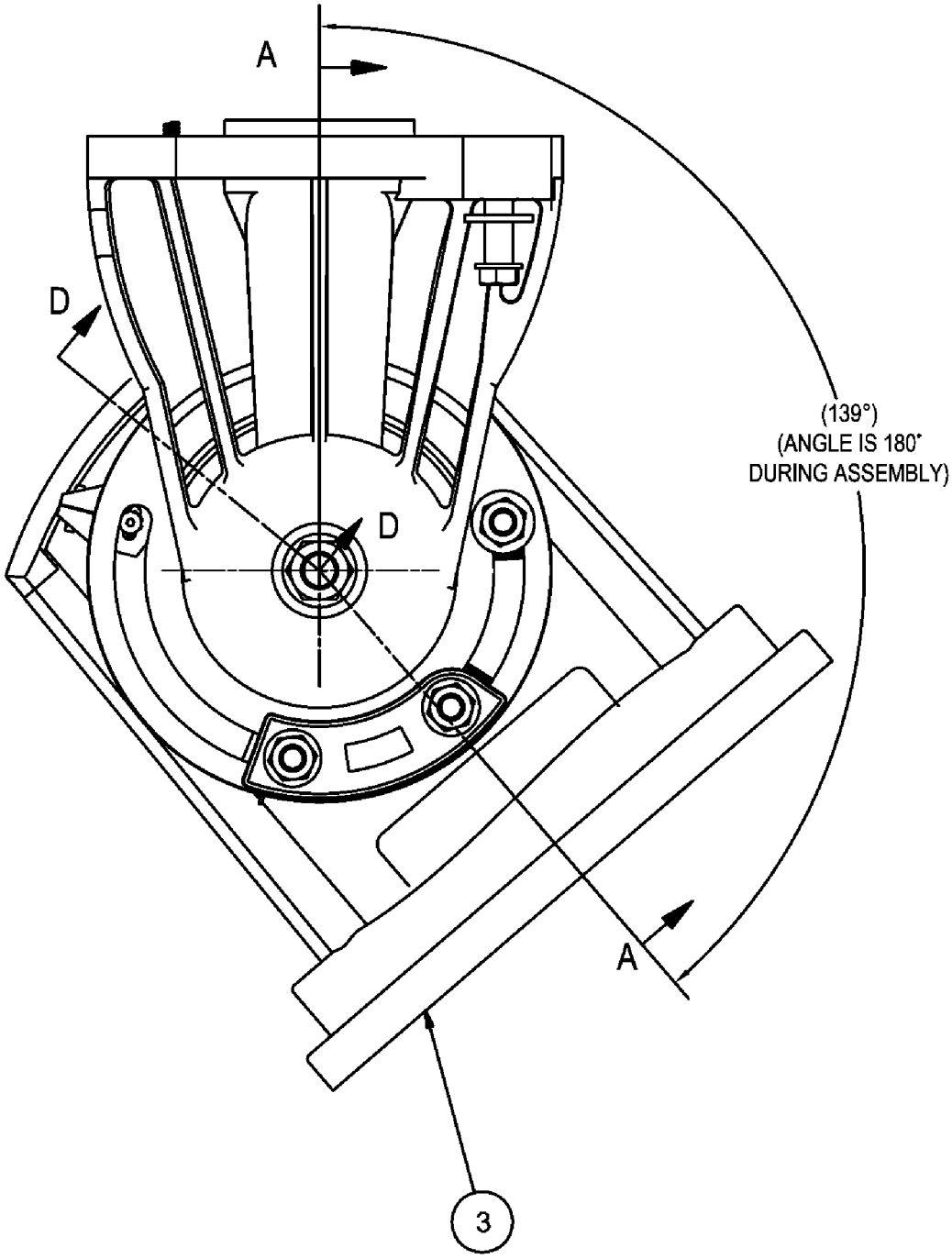
*Fig. 5J3*

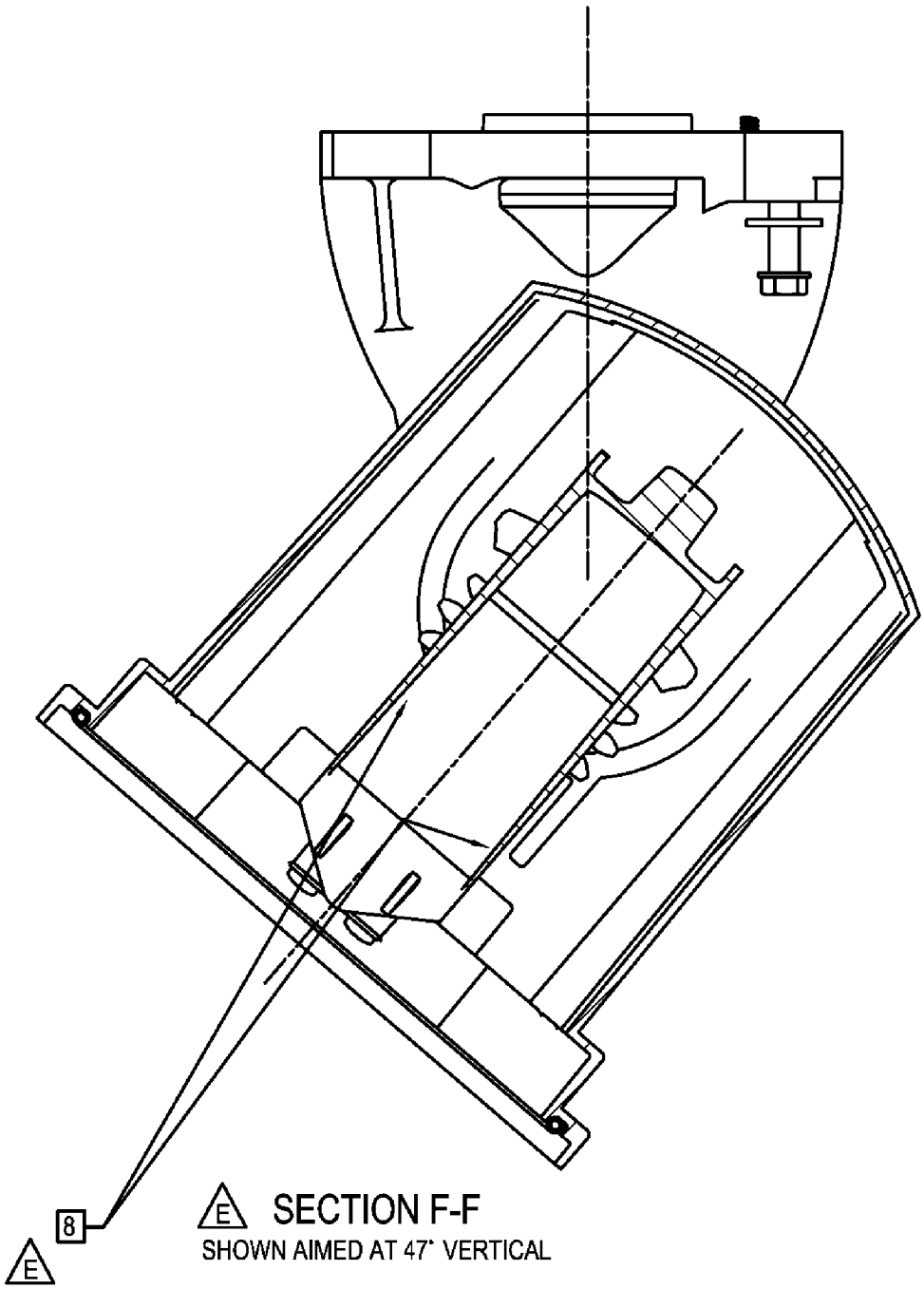
Fig. 5J4

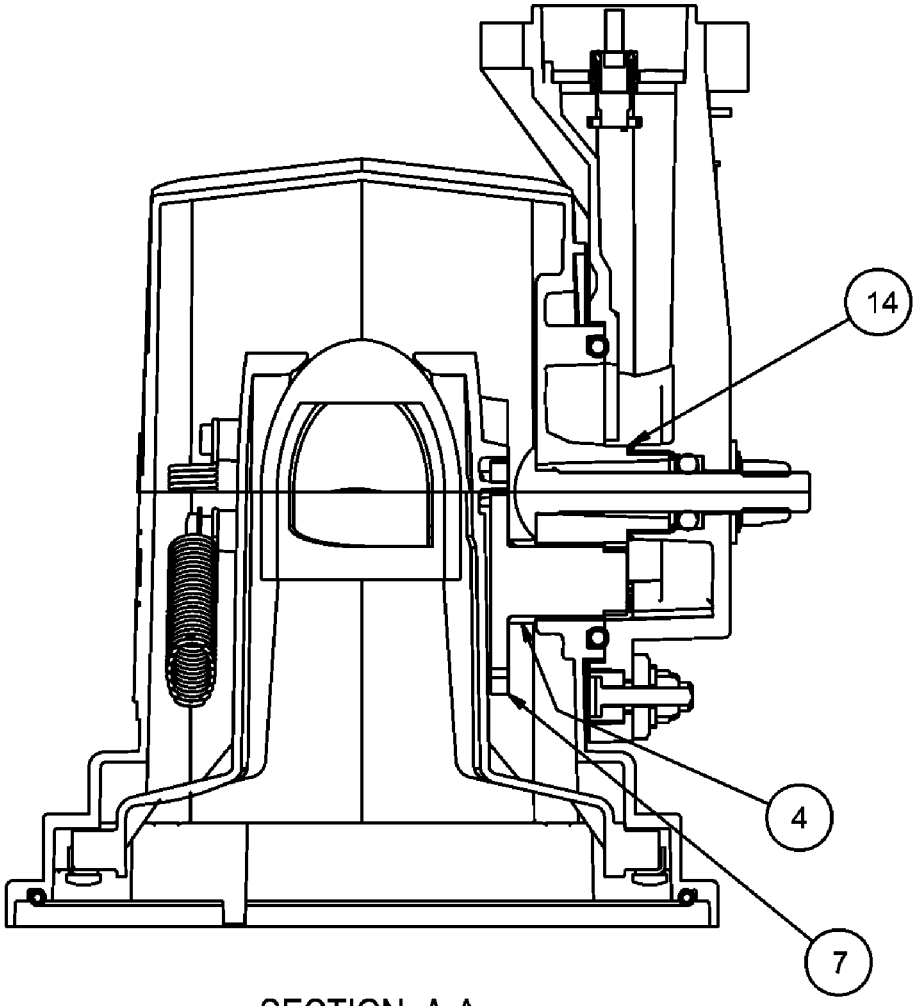
SECTION A-A
*Fig. 5J5*
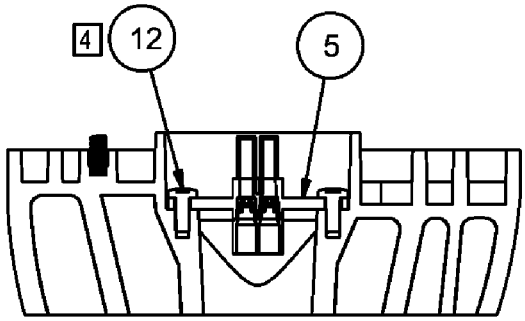
SECTION C-C
*Fig. 5J6*

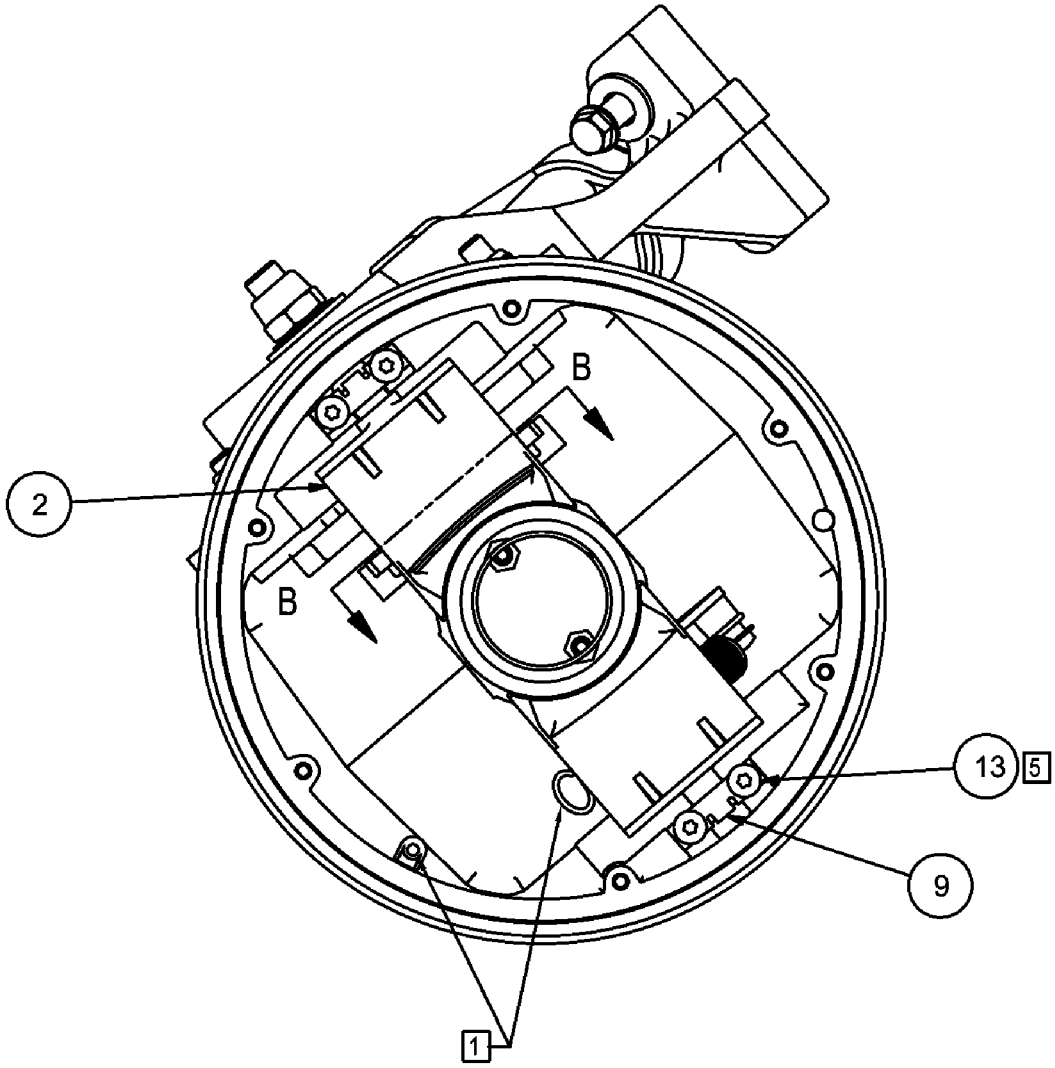
Fig.5J7
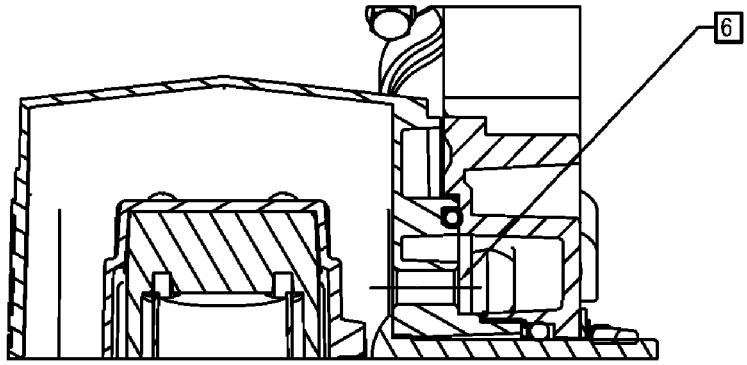
SECTION D-D
Fig.5J8

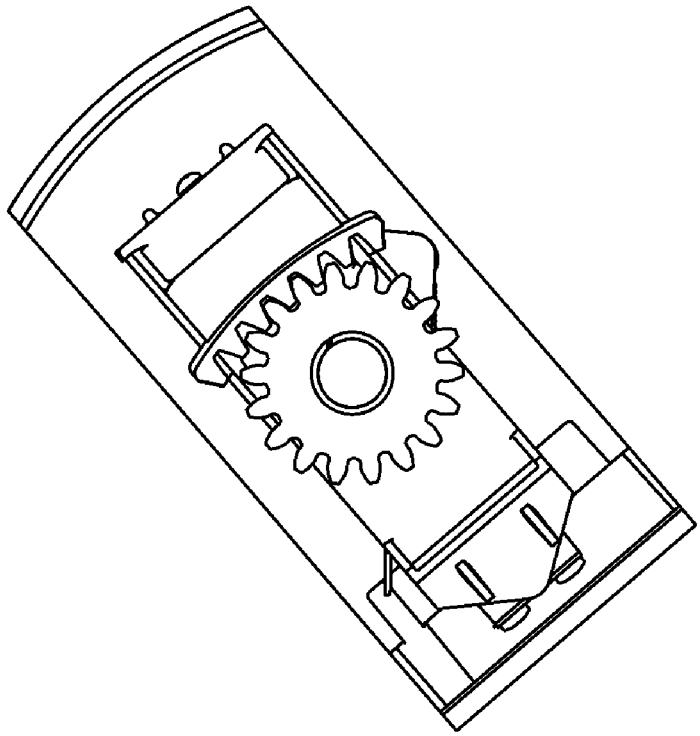
SECTION B-B
*Fig. 5J9*
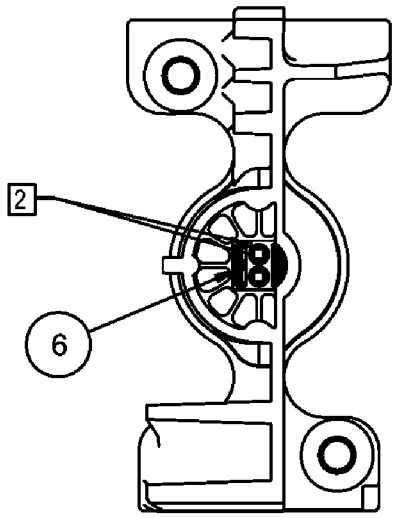
SECTION E-E
*Fig. 5J10*

MECHANISM TO INSURE CORRECT ROTATION OF ARC TUBE IN SOCKET

CROSS REFERENCE TO RELATED APPLICATIONS

This application claims priority under 35 U.S.C. § 119 of a provisional application U.S. Ser. No. 60/644,747 filed Jan. 18, 2005, herein incorporated by reference in its entirety. This application is also a non-provisional of the following provisional U.S. applications, all filed Jan. 18, 2005: U.S. Ser. No. 60/644,639; U.S. Ser. No. 60/644,536; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,638; U.S. Ser. No. 60/644,537; U.S. Ser. No. 60/644,637; U.S. Ser. No. 60/644,719; U.S. Ser. No. 60/644,784; U.S. Ser. No. 60/644,687, each of which is herein incorporated by reference in its entirety.

INCORPORATION BY REFERENCE

The contents of the following U.S. Patents are incorporated by reference by their entirety: U.S. Pat. Nos. 4,816,974; 4,947,303; 5,161,883; 5,600,537; 5,816,691; 5,856,721; 6,036,338.

I. BACKGROUND OF THE INVENTION

A. Field of the Invention

The present invention relates to lighting fixtures that produce high intensity, controlled, and concentrated light beams for use at relatively distant targets. One primary example is illumination of a sports field.

B. Problems in the Art

One type of wide area lighting fixture utilizes a lamp that includes an arc tube inside a glass envelope. One end of the lamp has an externally threaded metal base that is adapted to screw into a socket in the fixture. In this manner the lamps can be easily exchanged.

The lamps must be screwed in far enough so that appropriate electrical contact is made. Because of inherent manufacturing tolerances and other reasons, it is difficult to ensure that all lamps will end up in the same rotational orientation (position in a plane perpendicular the longitudinal axis of the lamp) when screwed into the socket.

This may not matter. However, certain lamps are designed to work best or are preferred in a certain rotational position. There is a need for way to ensure correct rotational position will occur for a lamp in a thread-in socket for these types of fixtures.

One example of a lamp that would benefit is the Z-lamp™ available from Musco Corporation, Oskaloosa, Iowa. It is disclosed at U.S. Pat. No. 5,856,721. This patent discloses ways in which the lamp and/or socket can be configured to try to insure consistent rotational position of the lamp (in this case to consistently ensure the longitudinal axis of the arc tube inside the glass envelope, which is angularly offset or tilted from the longitudinal axis of the lamp) ends up in a certain plane relative to either the fixture or to the ground. As explained in the patent, this promotes a reduction in tilt factor which can result in loss of light output from some of these types of lamps.

While these types of arrangements help ensure a predetermined rotational orientation of the lamp relative to the socket, it does not account for the fact the socket may end up in different rotational positions when installed in the fixture. Therefore, despite use of the methods disclosed in the Musco patent (e.g. pin on threaded base of lamp in alignment with plane of longitudinal axis of arc tube and helical slot in base with terminal end that would provide correct rotational orientation between lamp and socket), if the socket is not mounted in the correct position, the lamp may end up in the wrong rotational position.

II. SUMMARY OF THE INVENTION

It is therefore a principal object, feature, or advantage of the present invention to present a high intensity lighting fixture, its method of use, and its incorporation into a lighting system, which improves over or solves certain problems and deficiencies in the art.

The invention relates to an apparatus and method of assisting in ensuring the correct rotational position of a threaded base of a lamp for a wide area lighting fixture. The fixture includes structure to allow a range of rotational positions for the socket relative the fixture. The installer can utilize this feature to insure the correct rotational position of the socket when fixed to the fixture. This will then provide a consistent, correct socket orientation so that systems to ensure the correct rotational orientation of the lamp in the socket will be consistent.

These and other objects, features, advantages and aspects of the present invention will become more apparent with reference to the accompanying specification and claims.

III. BRIEF DESCRIPTION OF THE DRAWINGS

FIGS. 1A-G illustrates generally an example of a sports lighting system.

Figure 2A:
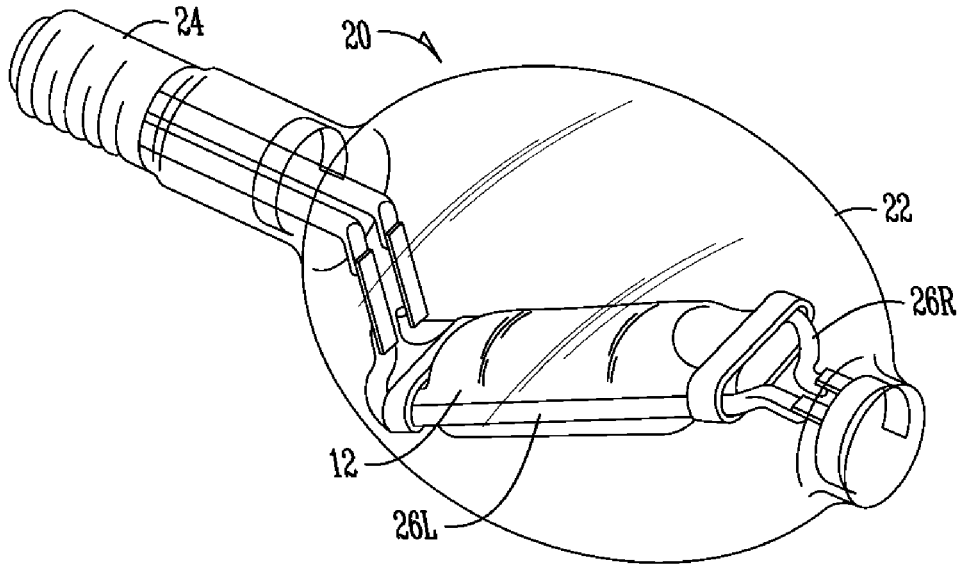
Figure 2B:
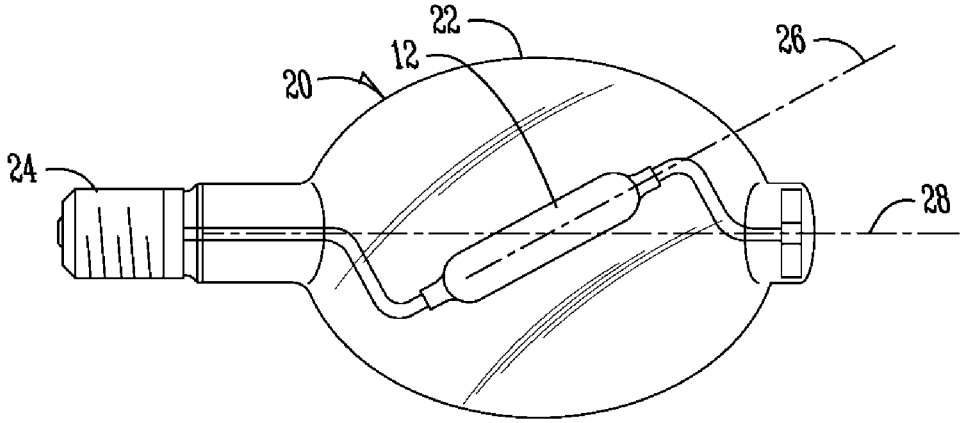
Figure 2C:
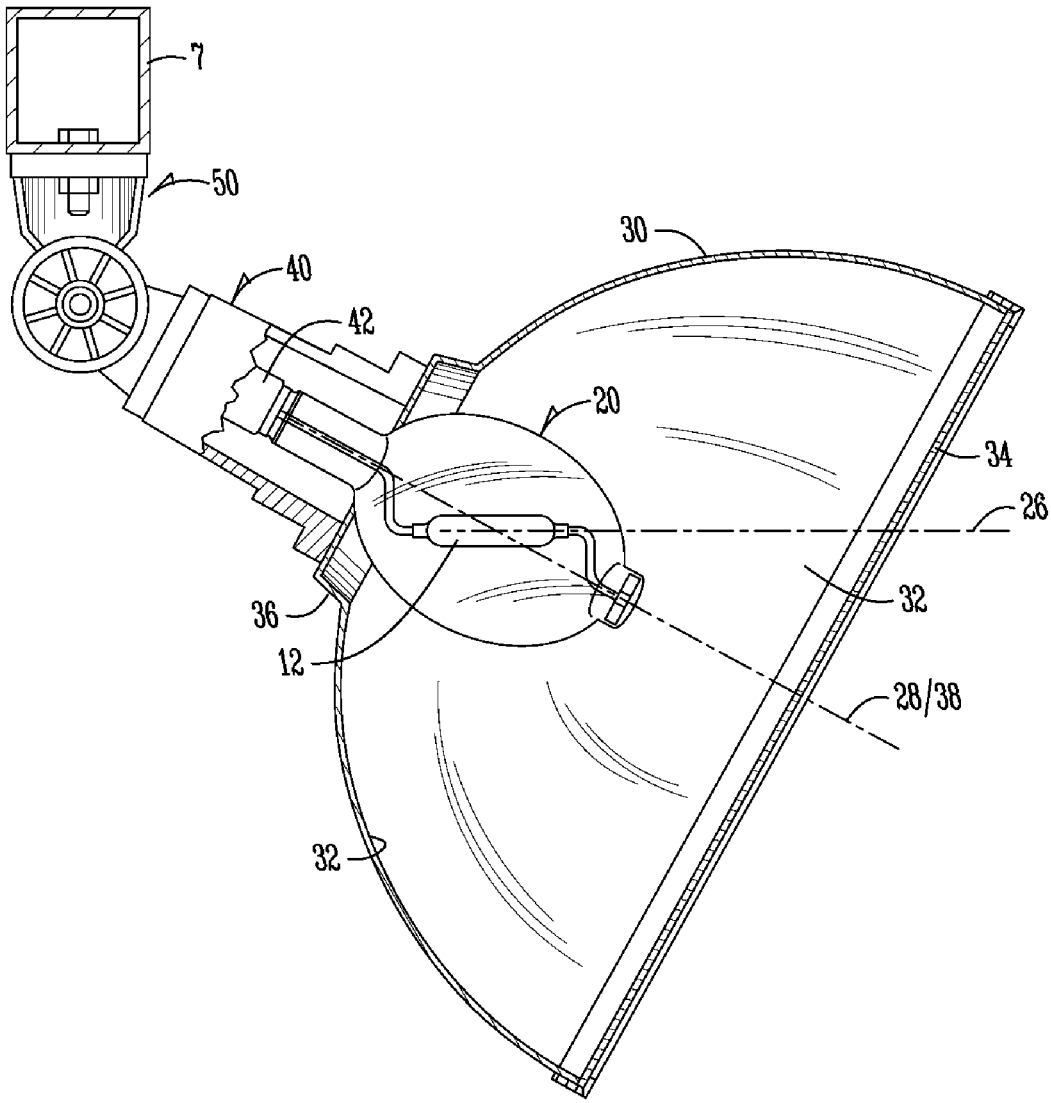

FIGS. 2A-C illustrates a high intensity discharge arc lamp that is used with an exemplary embodiment of the present invention where the arc tube is angularly rotated relative to the longitudinal axis of the arc lamp.

FIG. 3 is a diagrammatic, partially exploded view of a light fixture according to an exemplary embodiment of the present invention.

FIGS. 4A-D are various views of a lamp cone with an internal yoke to which the arc lamp can be removably mounted.

FIGS. 5A-J are additional views of the lamp cone.

FIGS. 6A-J are additional views of the lamp yoke inside the cone to which the lamp socket is mounted, according to the present invention.

IV. DETAILED DESCRIPTION OF EXEMPLARY EMBODIMENTS

A. Overview

For a better understanding of the invention, exemplary embodiments will now be described in detail. Frequent reference will be made to the accompanying drawings. Reference numerals and letters will be used to indicate certain parts and locations in the drawings. The same reference numerals or letters will be used to indicate the same parts and locations throughout the drawings unless otherwise indicated.

Figure 1A:
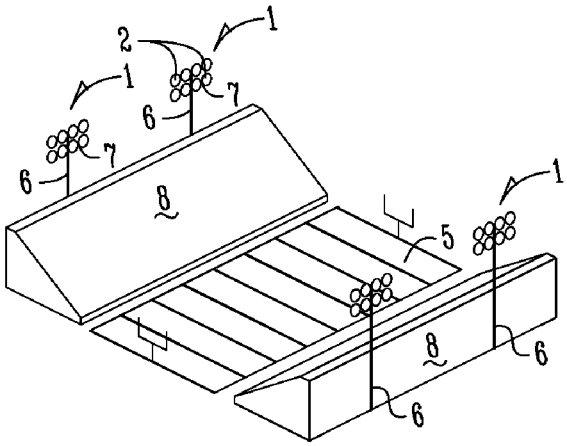
Figure 1B:
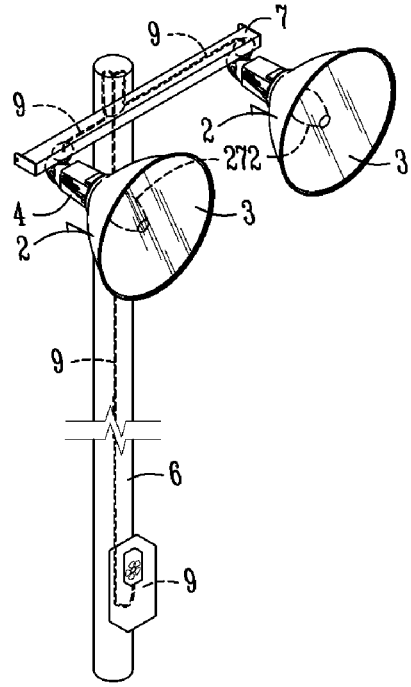
Figure 1C:
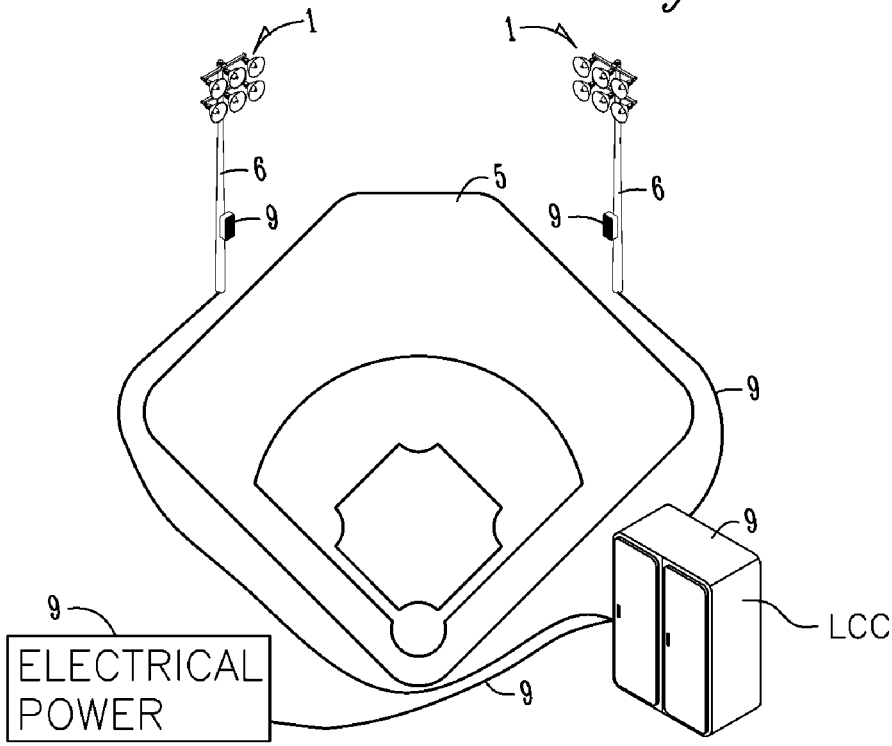
Figure 1D:
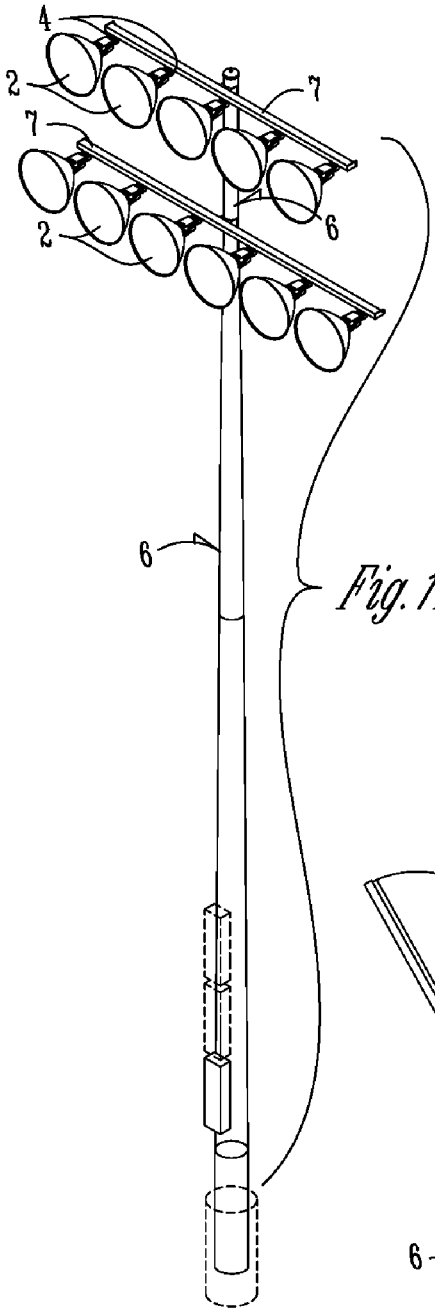
Figure 1G:
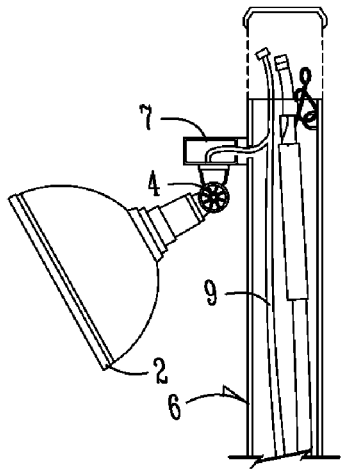
Figure 1E:
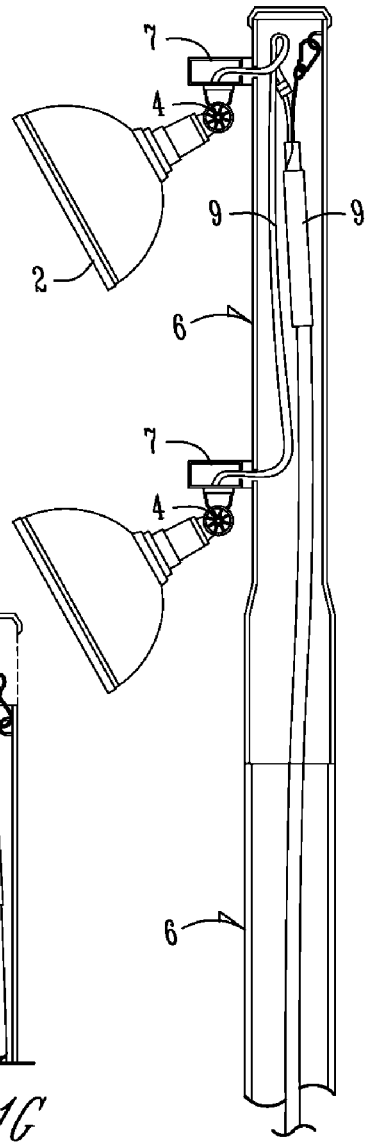
Figure 1F:
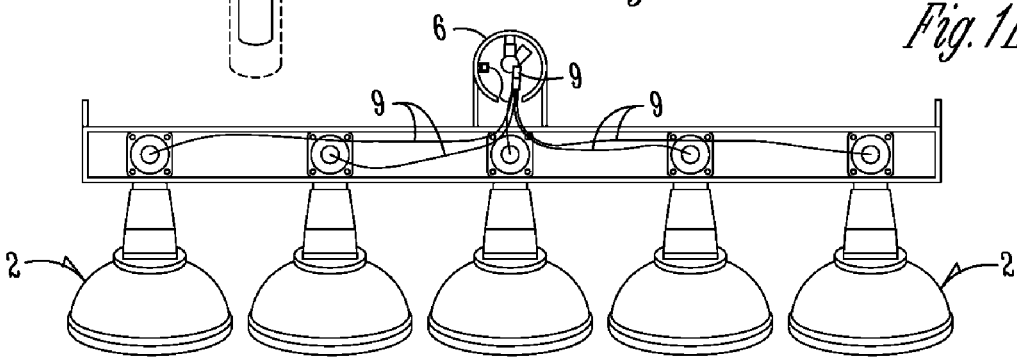

An embodiment of a light fixture will be described in the context of sports lighting, sports lighting fixtures, and sports lighting systems for the illumination of athletic fields such as shown in FIGS. 1A and 1C.

B. Exemplary Apparatus

1. Lighting Fixture 10 Generally

FIG. 4 shows the basic components of sports lighting fixture 10 in exploded form. Fixture 10 has some similar general components to state-of-the-art sports lighting fixtures, but introduces some different structural components and concepts. Mounting or knuckle plate 60 (360 Aluminum with polyester powder coat) bolts to the underside of a cross arm 7. It has adjustability around vertical axis 62. Knuckle 50 (360 Aluminum with polyester powder coat) bolts at one end to the bottom of knuckle plate 60 and extends to a pivot connection to lamp cone 40 along axis 52 at its other end (See FIG. 4). It should be appreciated that knuckle 50 essentially supports the remainder of fixture 10 and does so with essentially one arm extending from a cross arm down to one side of lamp cone 40. Knuckle 50 is a relatively non-complex structure.

Lamp cone 40 (360 Aluminum with polyester powder coat) pivots around axis 52 relative to knuckle 50. It contains a socket 154 (diagrammatically illustrated in FIG. 6A, commercially available) which is bolted to the flat web 160 between the arms 156 and 158 of yoke 80 (see FIG. 6A). Lamp 20 (Musco Corporation Z-Lamp™) has a threaded base that can be screwed in and out of socket 154 (shown screwed into operating position in FIG. 2C) to install or remove lamp 20.

Reflector frame 30 (cast aluminum type 413) bolts to lamp cone 40. Primary reflecting surface 32, here comprising a number of high total reflectance rated side-by-side strips is mounted inside reflector frame 30. Reflector frame 30 has a main portion that follows a surface of revolution, but at least one differently oriented portion. Frame 30 is thus pre-designed to shift part of the light beam that will be generated by the reflecting surface once applied to frame 30. The frame for glass lens 32 is removably latched to the front of reflector frame 30. Visor 70 is mountable to the lens frame and extends from the upper front of reflector frame 30 when in place. It includes high reflectivity strips on its interior 72. See U.S. Pat. No. 6,036,338.

2. Lamp 20

Arc lamp 20 is of the general type disclosed in Musco Corporation U.S. Pat. No. 5,856,721, incorporated by reference herein, with certain modifications. These types of lamps are used by Musco Corporation under the trademark Z-Lamp™ and typically are 1000 watt or greater metal halide (MH) HID lamps (see also FIGS. 2A-C). Its arc tube 12 is tilted obliquely across the longitudinal axis of the arc lamp 20. In operation, it is rotationally positioned in fixture 10 such that the longitudinal axes of the arc tube and the lamp define a vertical plane, and the longitudinal axis of arc tube 12 is as close to a horizontal plane as possible.

3. Reflector Frame 30 Generally

FIG. 4 illustrates details of reflector frame 30. It is die-cast aluminum (e.g., aluminum type 413). It could be made of other materials (e.g. powder-coated steel). Unlike state-of-the-art bowl-shaped spun aluminum reflectors, it does not have any surface that is intended for controlled reflection of light to the target area. Therefore, it does not require much post-casting processing. It provides the basic framework or support for primary reflecting surface 32, which shapes and controls most of the light beam of fixture 10. It does have basically a bowl-shape with an external surface that is substantially closed and smooth.

When assembled, lamp 20 extends through an opening at the bottom or center of reflector frame 30 and is substantially centered in reflector frame 30. High reflectivity reflecting surface 32 surrounds a substantial part of the glass envelope of lamp 20 around arc tube 12. An orthogonal plane laterally across the middle of arc tube 12 (its equator) projects substantially to reflecting surface 32, but since arc tube 12 is tipped up relative the center aiming axis of reflector frame 30 (the longitudinal axis of lamp 20 is generally along the center axis of reflector frame 30), part of its projected equator extends obliquely out the front opening of reflector frame 30.

4. Lamp Cone 40, Knuckle 50, and Knuckle Plate 60

Lamp cone 40, knuckle 50, and knuckle plate 60 form the adjustable joint between cross arm 7 and reflector frame 32. Lamp cone 40 also supports lamp 20. FIGS. 4A-D and 5A-J illustrate details about lamp cone 40. Lamp cone 40 is basically enclosed except for front opening 132 to which reflector frame 30 is bolted and sealed with a gasket, and several opening in the side (e.g., for the knuckle bolt and a pinion gear).

5. Yoke 80

Figure 5C:
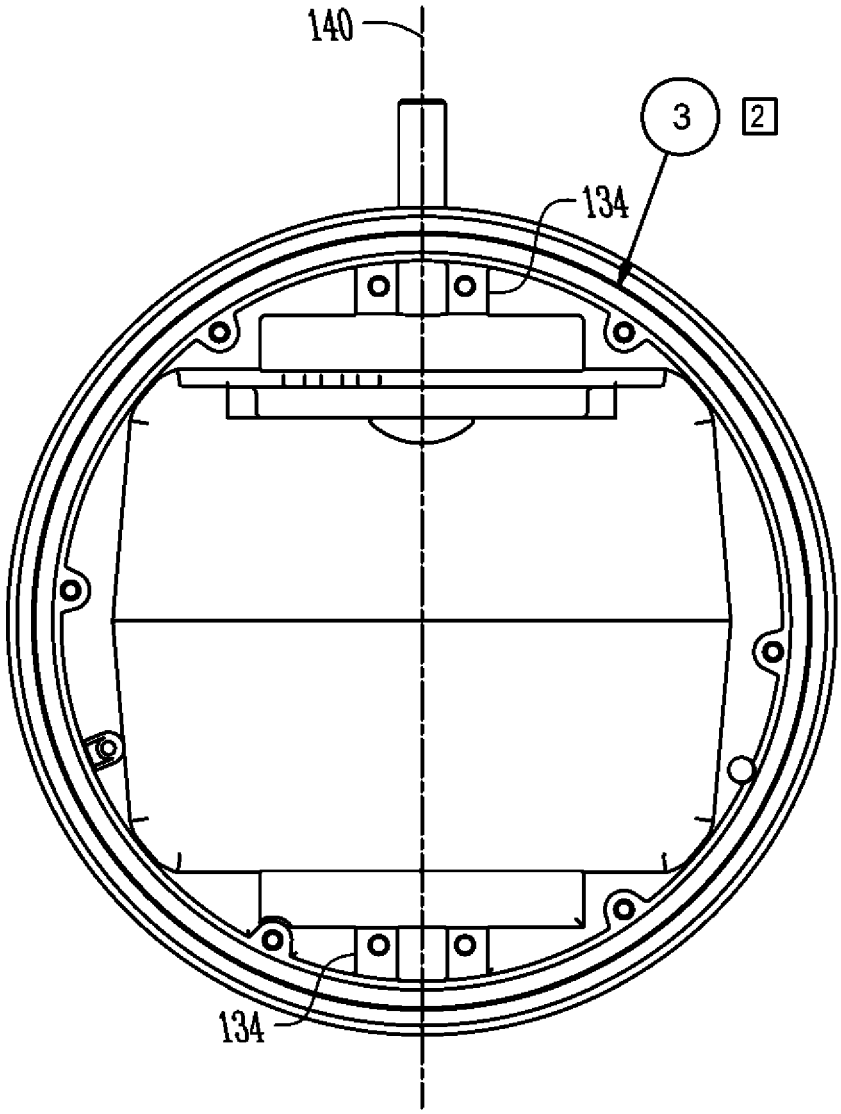
Figure 5D:
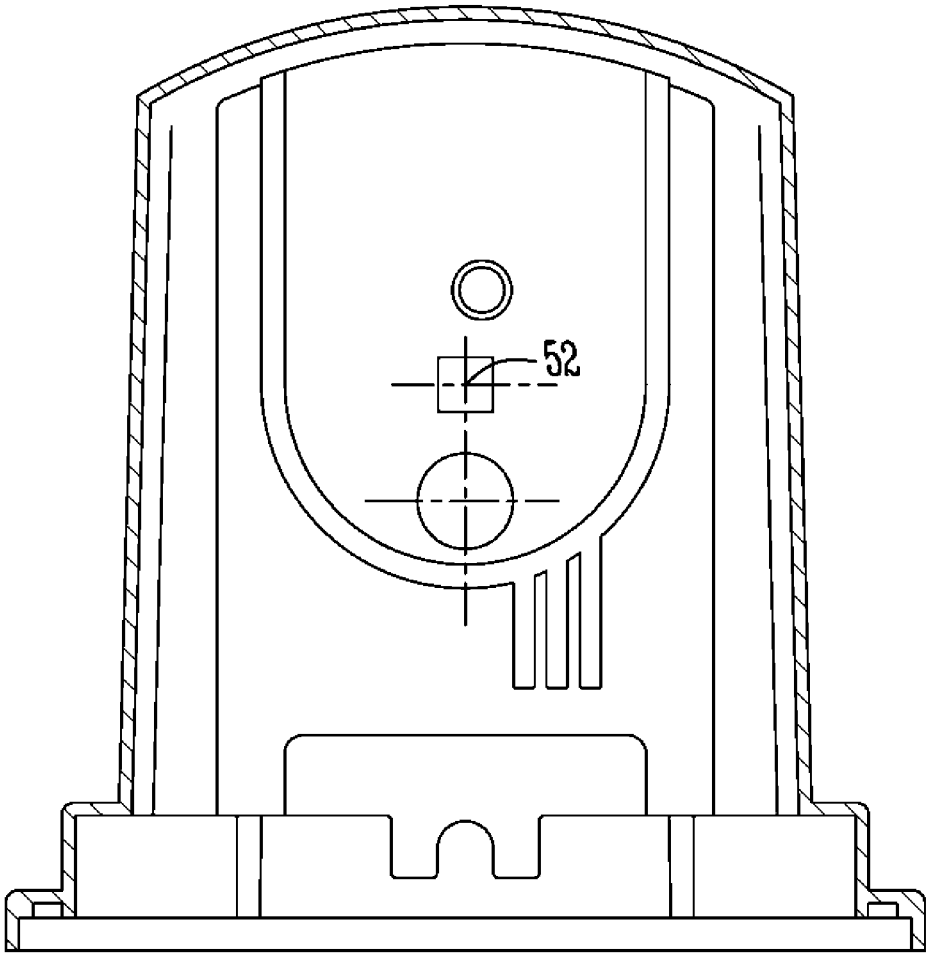
Figure 5E:
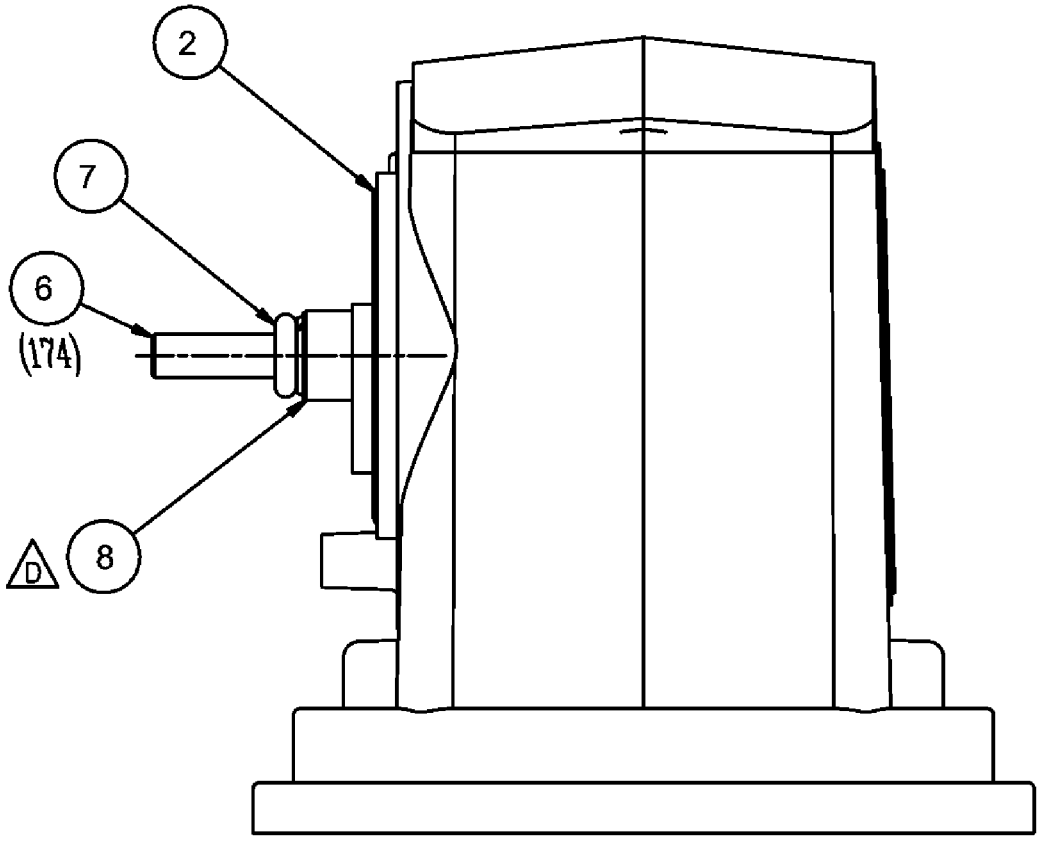
Figure 5F:
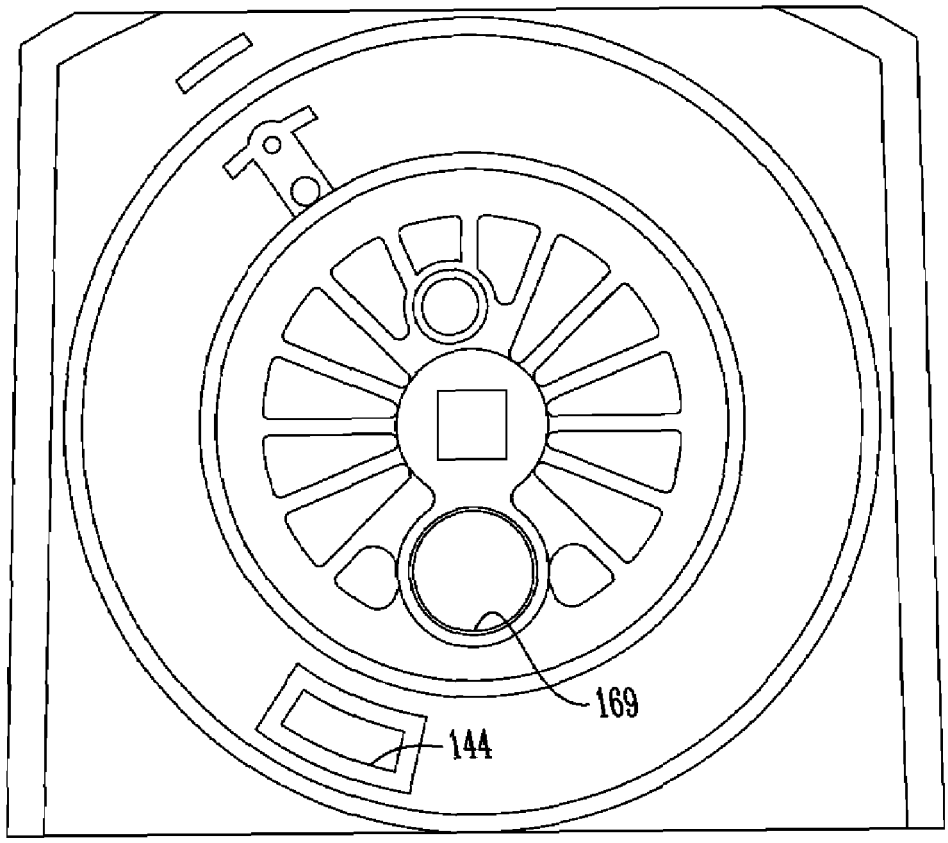
Figure 5H:
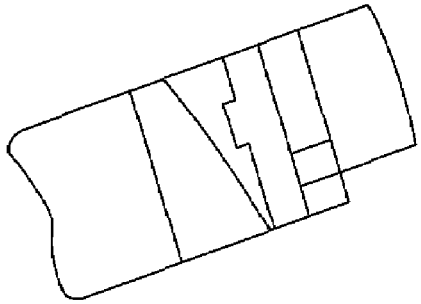
Figure 5I:
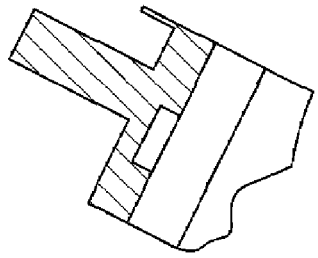
Figure 5C:
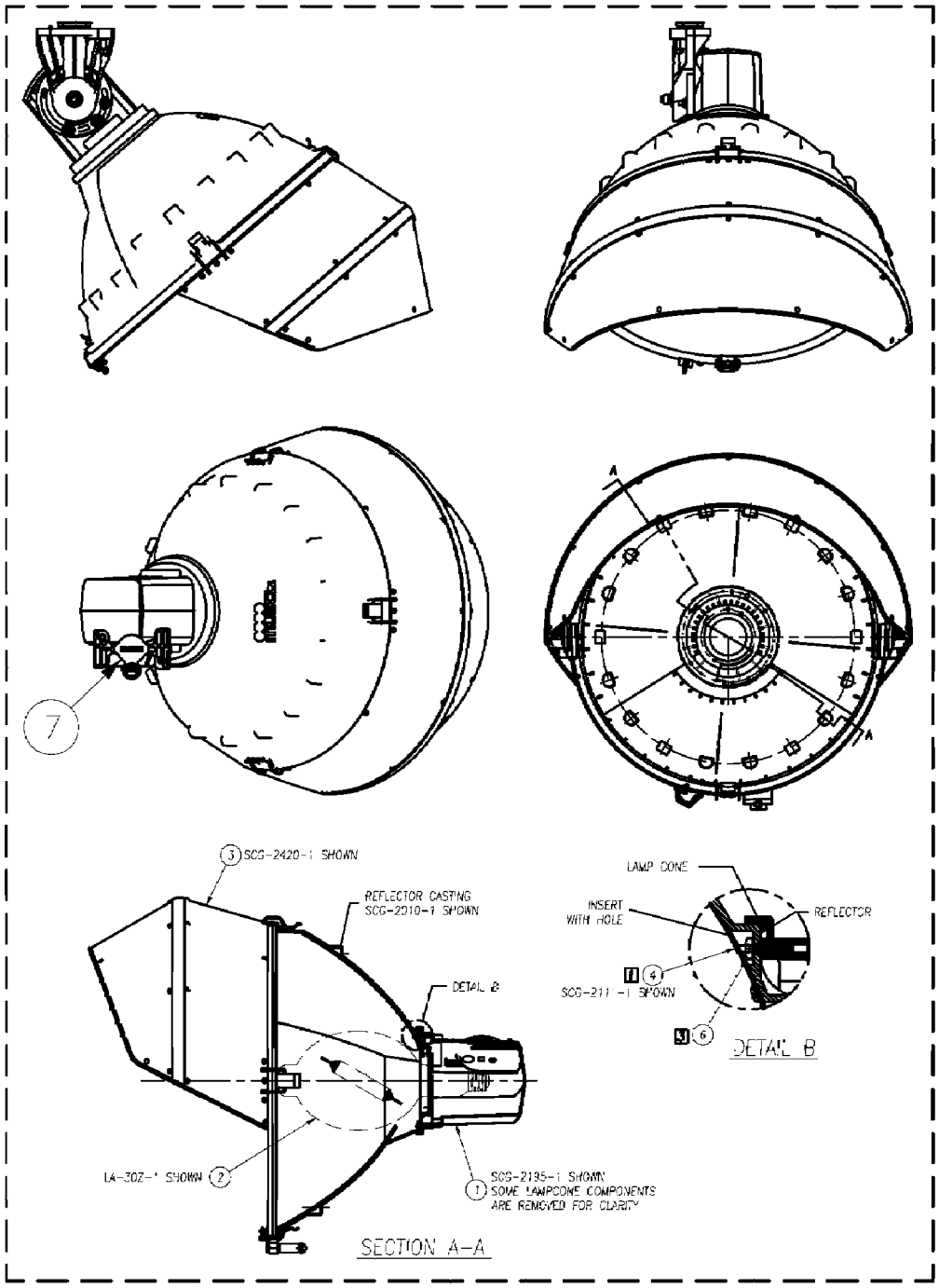

Yoke 80 is pivotally supported at the front of lamp cone 40 at pivot axis 140 (see FIG. 3 and FIG. 5C). Pivot pins 152 of lamp yoke 80 (see FIG. 6A—and described in more detail below) slide longitudinally into mating receivers (which define pivot axis 140) on opposite sides of opening 132 to lamp cone 40 and are retained in place by yoke retainers by machine screws in the pair of threaded bores on opposite sides of receivers.

Lamp socket 154 is mounted between arms 156 and 158 of yoke 80 via bolts, screws or other means through the back end 160 of yoke 80. Yoke 80 therefore can pivot around an axis 140 defined by receivers 134 in lamp cone 40. In combination with a setting of gearing, pivotable yoke 80 allows arc tube 12 of arc lamp 20, which is supported by yoke 80, to be maintained in a horizontal position independent of tilt of lamp cone 40. FIGS. 4A-F, along with FIGS. 5A-J and FIGS. 6A-J, illustrate this total tilt factor correction feature of fixture 10.

Figure 6A:
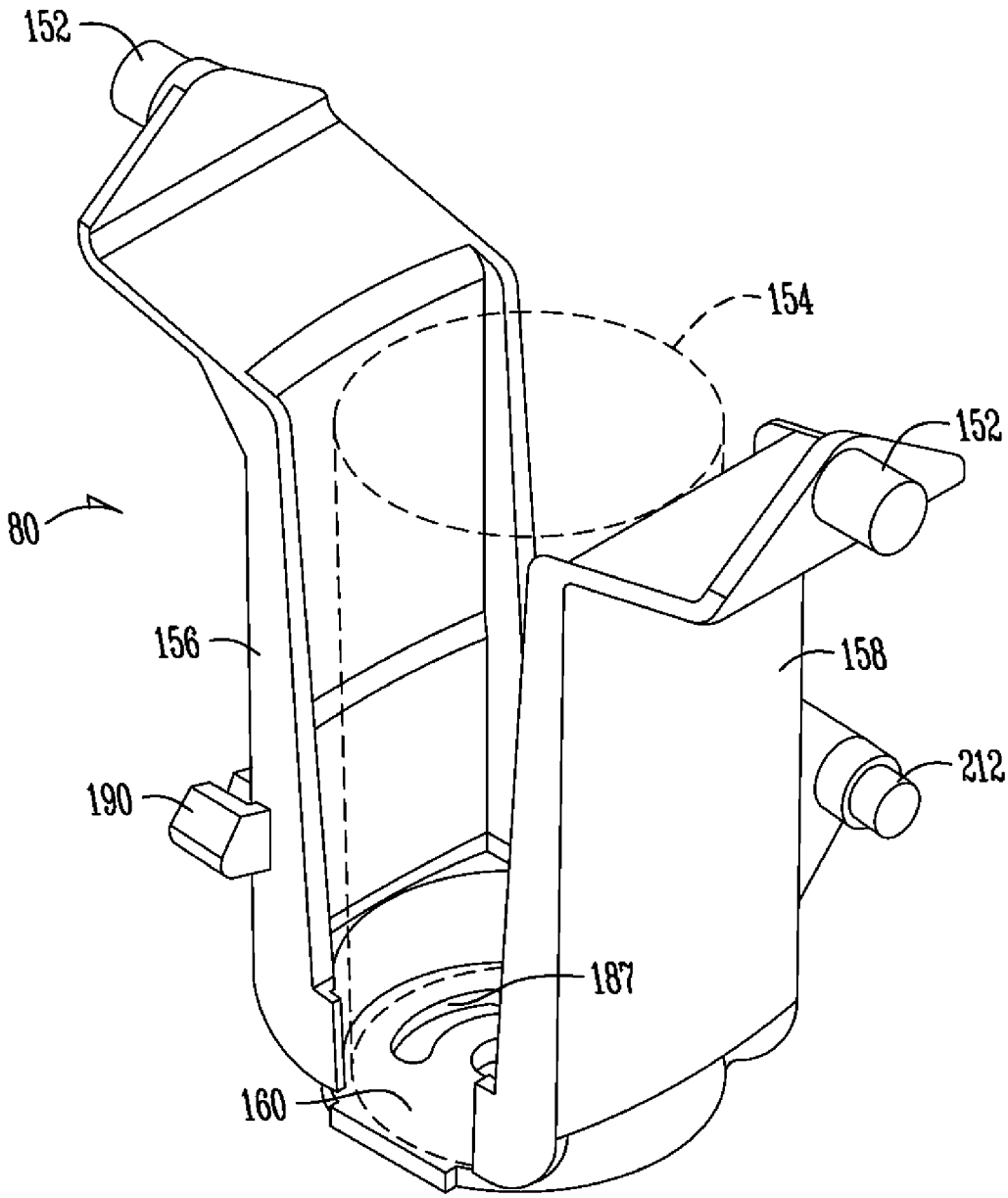
Figure 6B:
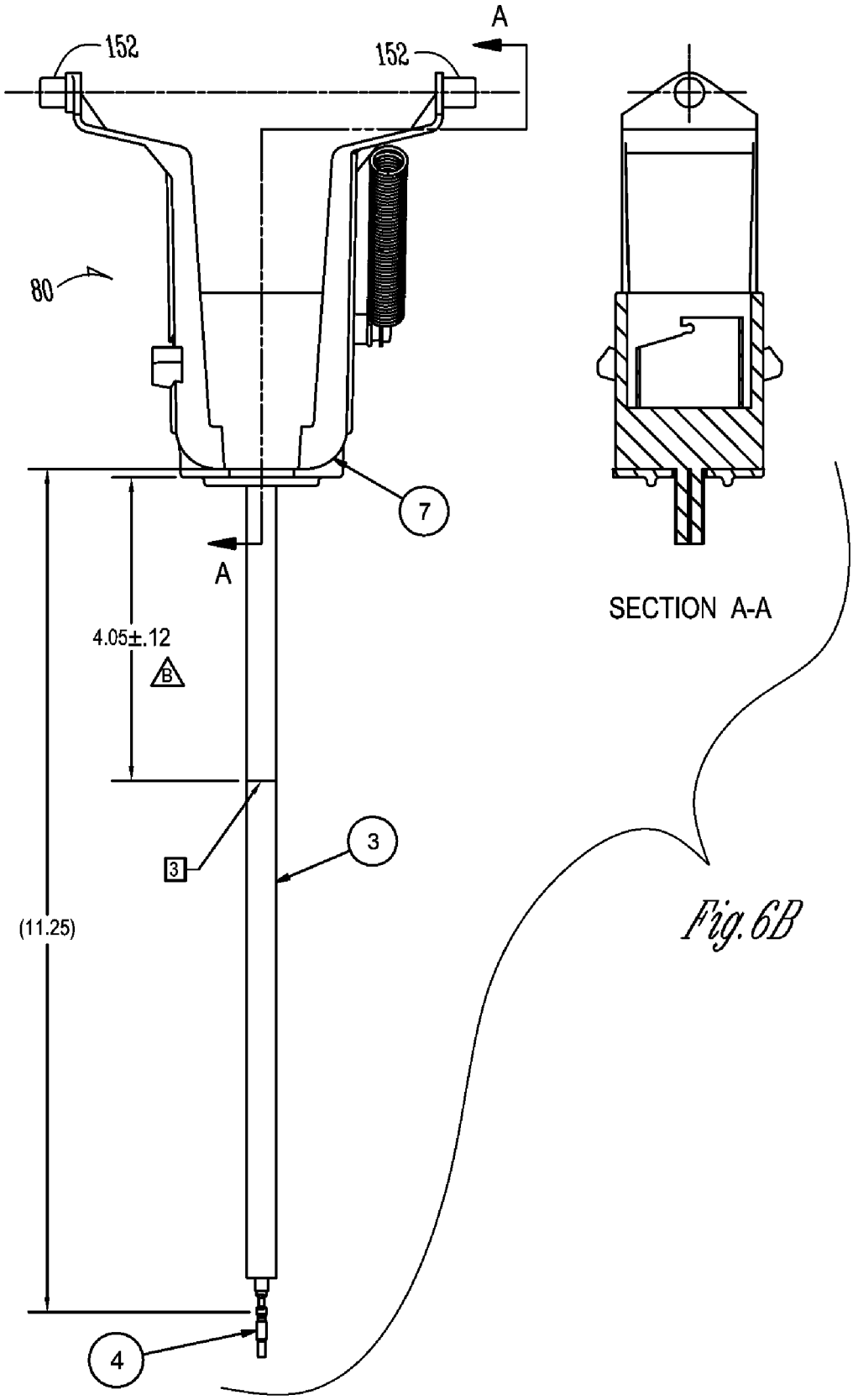
Figure 6C:
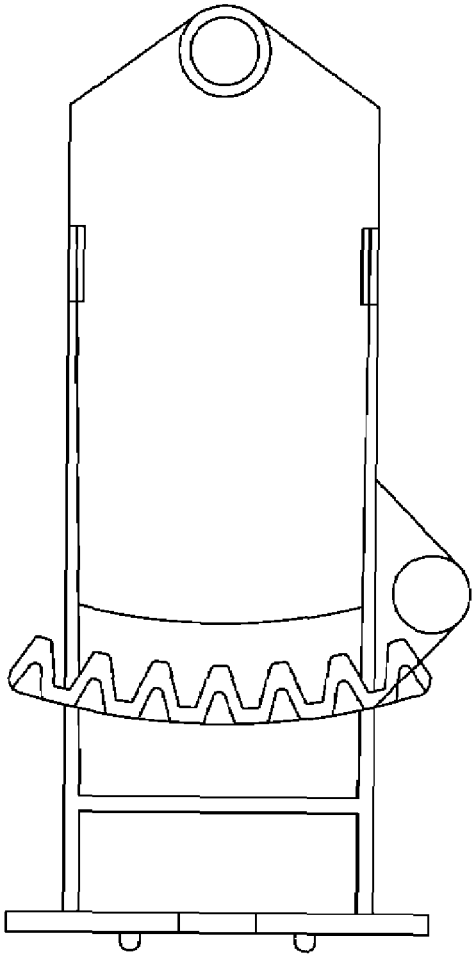
Figure 6D:
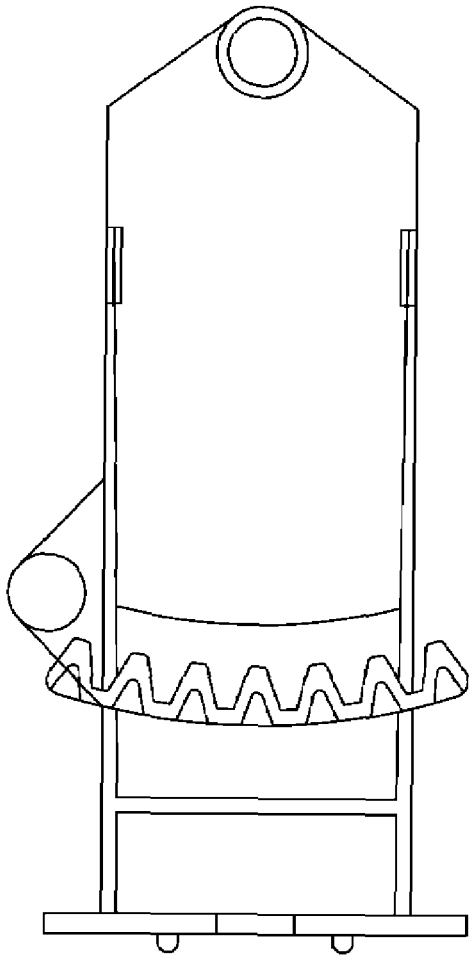
Figure 6E:
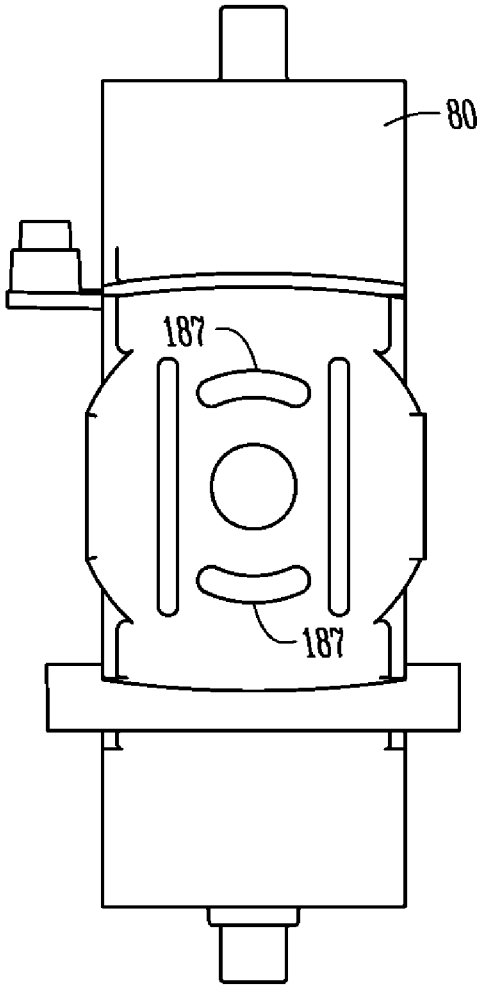
Figure 6F:
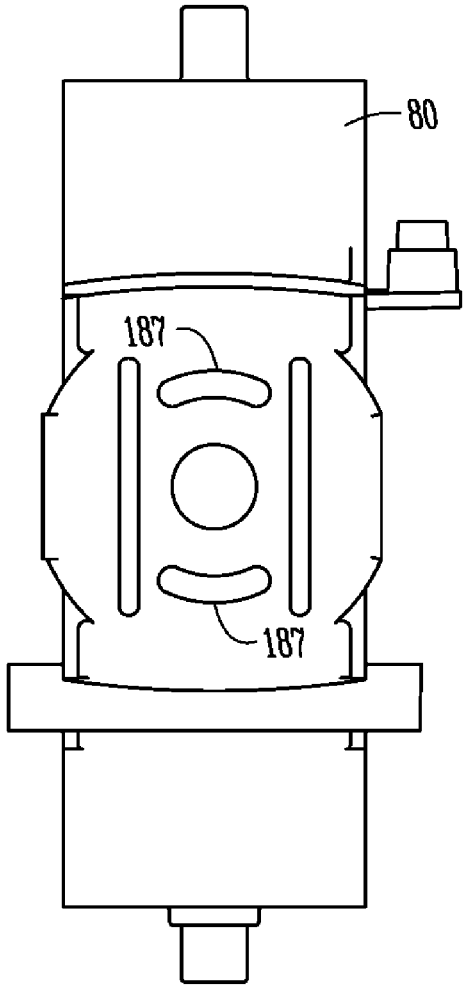
Figure 6C:
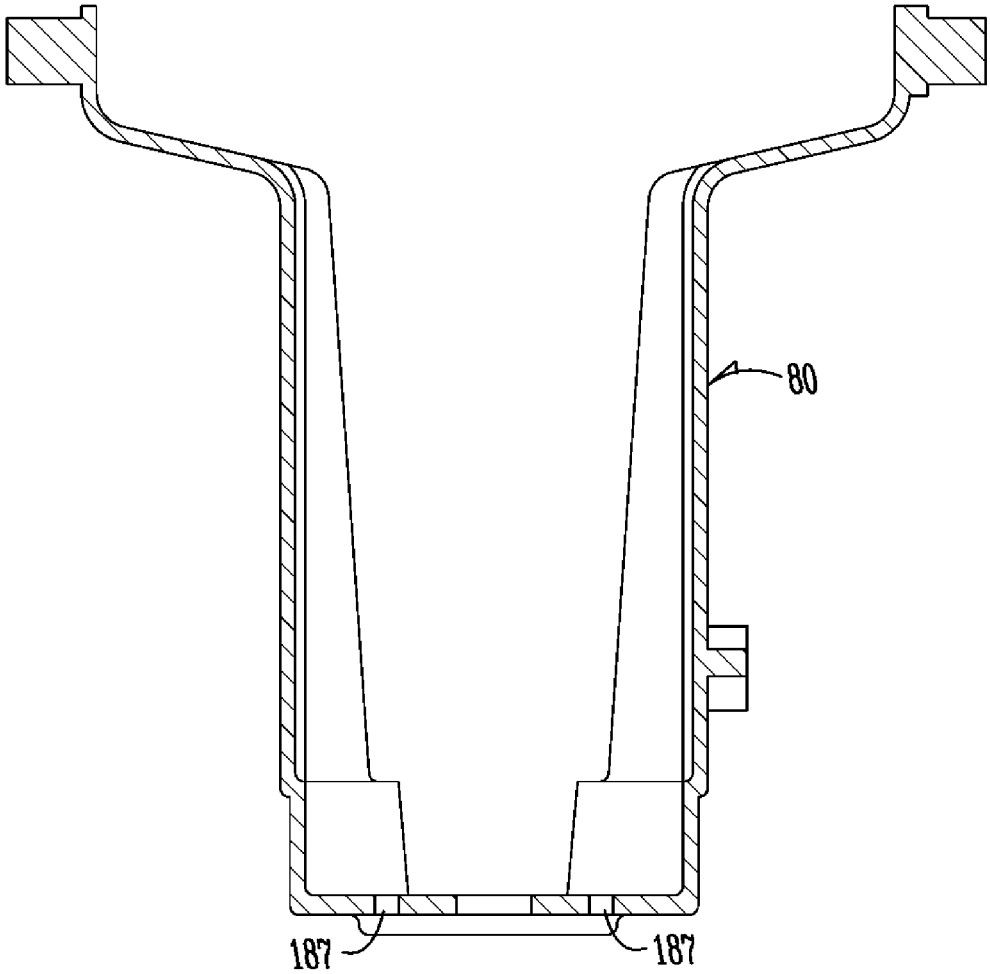
Figure 6H:
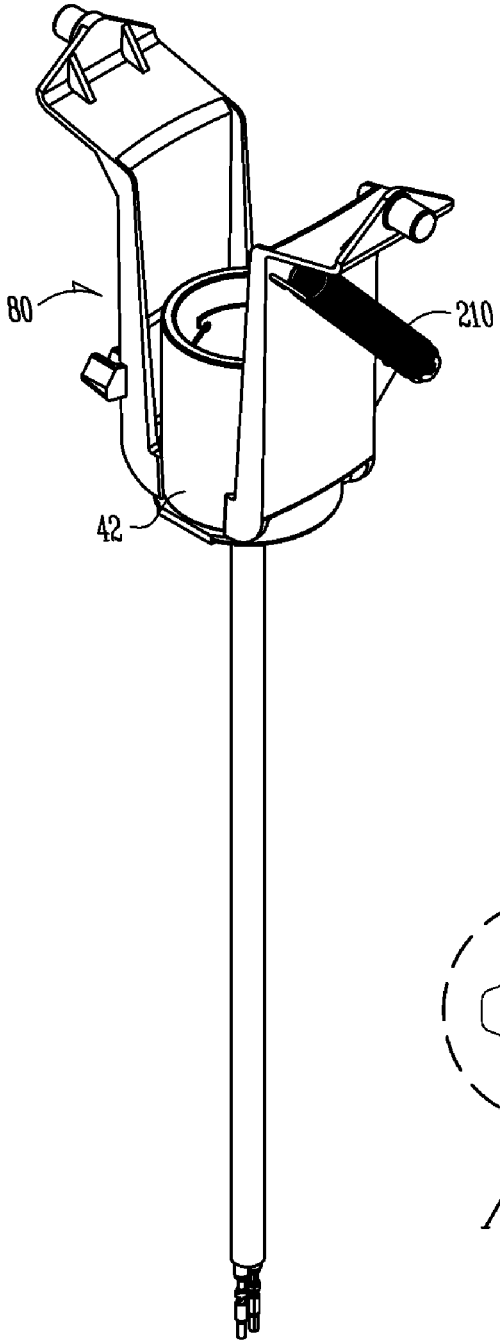
Figure 6I:
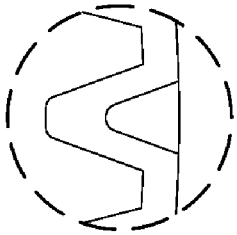
Figure 6J:
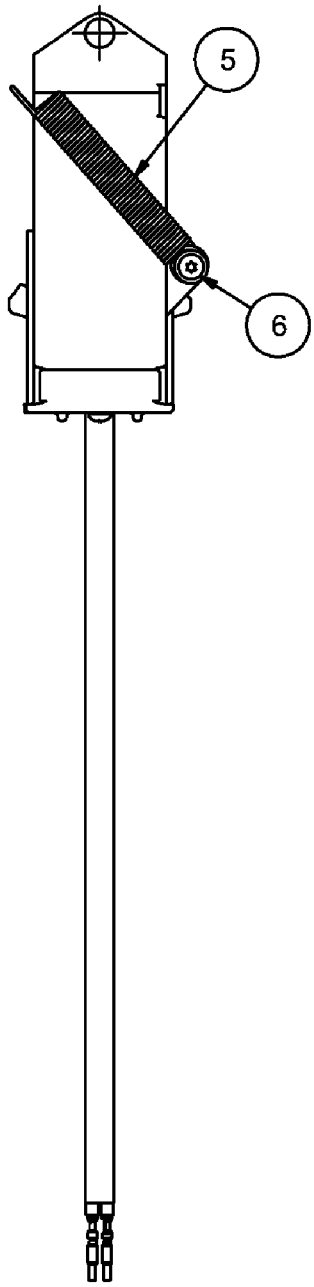

The socket 154 for lamp 20 mounts to two arcuate slots 187 in the bottom of yoke 80 (FIG. 6F). These correction slots allow, if needed, slight rotation of the socket in case arc tube 12 does not end up in correct rotational orientation relative to horizontal. Lamp 20 can have a pin extending laterally from its base and socket 154 a spiral groove (see Musco U.S. Pat. No. 5,856,721). The end of the groove can be designed as an end stop to rotation of the base of lamp 20 into socket, and at a lamp rotational position that is correct for horizontal operation of arc tube 12. However, sometimes there is pin misalignment on the lamp base or in the slot in the socket. There can also be some misalignment of the glass envelope of lamp 20 relative to its threaded base or its arc tube 12. The correction slots allow the lamp assembler to check for correct Z-Lamp™ rotational orientation and if, for some reason, it is not correct, the worker can rotate the socket to compensate. Also, the flat mounting surface at the bottom of yoke 80 makes it easier to ensure correct alignment, in comparison, for example, with lamp mounts for spun reflectors. It is difficult to get a flat mounting surface for the lamp cone on a spun reflector. This can create misalignment of lamp 20 relative to both the spun reflector and to horizontal. But since lamp 20 in fixture 10 is mounted to a flat surface and is adjustable, precise positioning is available.

C. Options and Alternatives

It will be appreciated that the foregoing exemplary embodiment is given by way of example only and not by way of limitation. Variations obvious to those skilled in the art will be included in the invention. The scope of the invention is defined solely by the claims.

For example, variations in dimensions, materials, and combinations are contemplated by the invention. In particular, all of the features and aspects of the exemplary embodiment are not required to produce a beneficial or advantageous result.

It can be seen, therefore, that by providing some rotational adjustability of the socket to which the lamp is threadably mounted, easy alignment of an offset arc tube can be accomplished. This removes some of the issues with other prior methods of trying to ensure relatively accurate and repeatable rotational installation of a thread-in arc lamp; in particular one that is consistent from fixture to fixture and lamp to lamp. In other words, instead of relying on some manufacturing process or structure relative to the lamp, the receiver for the lamp has some rotational adjustment. By means well within the skill of those skilled in the art, the electrical connections and other functions of the socket can adapt to some reasonable range of rotation of the socket.

What is claimed is:

1. An apparatus for allowing rotational adjustment of a thread-in HID light source relative to a lighting fixture lamp where the HID light source has a male threaded end, a lamp axis and an arc tube that is offset and/or tilted relative the lamp axis comprising:

a. a socket having a socket axis adapted to receive the male threaded end of the HID;

b. a mounting interface mounted in the light fixture, the mounting interface adapted to allow a range of rotation of the socket around the socket axis.

2. The apparatus of claim 1 wherein the light source arc tube is tilted approximately 300 from the lamp axis and the lamp axis is generally aligned with the socket axis when installed in the socket.

3. The apparatus of claim 1 wherein the mounting interface comprises opposing curved slots on opposite sides of the socket axis.

4. The apparatus of claim 3 wherein the mounting interface includes pins or bolts which mount the socket to the mounting interface.

5. The apparatus of claim 4 wherein the pins or bolts are releasably securable to the mounting interface to allow movement within the slots and fixing the rotational position of the socket relative to the socket axis.

* * * * *

UNITED STATES PATENT AND TRADEMARK OFFICE

CERTIFICATE OF CORRECTION

PATENT NO. : 7,547,118 B2
APPLICATION NO. : 11/333118
DATED : June 16, 2009
INVENTOR(S) : Myron K. Gordin et al.

It is certified that error appears in the above-identified patent and that said Letters Patent is hereby corrected as shown below:

Col. 6, Claim 2, Line 7:
Delete after approximately "300"
Add after approximately --30°--

Signed and Sealed this

Seventeenth Day of November, 2009

David J. Kappos

David J. Kappos
*Director of the United States Patent and Trademark Office*